US006219993B1

(12) United States Patent
Linkiewicz

(10) Patent No.: US 6,219,993 B1
(45) Date of Patent: Apr. 24, 2001

(54) ZIPPER SEALER MACHINE

(75) Inventor: John M. Linkiewicz, Prospect Heights, IL (US)

(73) Assignee: Triangle Package Machinery Company

( * ) Notice: Subject to any disclaimer, the term of this patent is extended or adjusted under 35 U.S.C. 154(b) by 0 days.

(21) Appl. No.: 09/490,342

(22) Filed: Jan. 24, 2000

Related U.S. Application Data

(60) Division of application No. 09/164,611, filed on Oct. 1, 1998, now Pat. No. 6,021,621, which is a continuation-in-part of application No. 09/056,583, filed on Apr. 7, 1998, now Pat. No. 6,012,264.

(51) Int. Cl.[7] ..... B65B 51/04

(52) U.S. Cl. ..... 53/139.2; 53/451; 53/552; 53/555; 493/927; 493/213

(58) Field of Search ..... 53/139.2, 451, 53/138.1, 551, 552, 554, 555; 493/927, 212, 213, 388

(56) References Cited

U.S. PATENT DOCUMENTS

| | | | | |
|---|---|---|---|---|
| 4,355,494 | | 10/1982 | Tilman . | |
| 4,430,070 | | 2/1984 | Ausnit . | |
| 4,546,596 | * | 10/1985 | Cherney | 53/451 |
| 4,617,683 | * | 10/1986 | Christoff | 53/451 |
| 4,625,496 | | 12/1986 | Ausnit . | |
| 4,655,862 | * | 4/1987 | Christoff et al. | 493/927 |
| 4,844,759 | | 7/1989 | Boeckmann . | |
| 4,846,585 | | 7/1989 | Boeckmann et al. . | |
| 4,876,842 | | 10/1989 | Ausnit . | |
| 4,894,975 | * | 1/1990 | Ausnit | 53/133 |
| 4,909,017 | * | 3/1990 | McMahon et al. | 53/451 |
| 4,925,316 | | 5/1990 | Van Erden et al. . | |
| 4,971,454 | | 11/1990 | Branson et al. . | |
| 5,024,537 | | 6/1991 | Tilman . | |
| 5,036,643 | | 8/1991 | Bodolay . | |
| 5,111,643 | | 5/1992 | Hobock . | |
| 5,127,208 | * | 7/1992 | Custer et al. | 53/139.2 |

(List continued on next page.)

*Primary Examiner*—Peter Vo
*Assistant Examiner*—Louis K. Huynh
(74) *Attorney, Agent, or Firm*—Brinks Hofer Gilson & Lione

(57) ABSTRACT

A zipper sealer machine for use with a form, fill and seal machines and the method for bonding strips of reclosable fastener material to the film of a form fill and seal machine. Strips of reclosable fastener material arc cut and the cut ends fused together by cutter-fuser jaws. A sensor senses when the cutter-fuser jaws become fully closed and when they begin to open so that other steps in the operation can be based on when the jaws actually begin to open and when they are actually fully closed rather than when the signal is sent that causes them to open and close. The cutter-fuser jaws have been coated with an anti-stick substance to prevent sticking of the flanges to the cutter-fuser jaws. The cut strips of reclosable fastener material are held on an edge of the rotor that is remote from the film surface. Upon rotation of the rotor the held strip of reclosable fastener material is moved to a location adjacent to the film surface. During the process of releasing the strip of reclosable fastener material from the rotor the free end of the continuous supply is pre-advanced to a position adjacent to the rotor to minimize the time required for the final advance of the next strip of reclosable fastener material, and to aid in engaging the zipper with the rotor track. A stand-by mode for the form, fill and seal machine has been developed during which the free end of the reclosable fastener material is drawn back into a track that protects it from the heat generated by the cutter-fuser jaws. An air cylinder brake has been provided that holds the flange of the reclosable fastener material after the cutter-fuser jaws have been closed to hold the severed strip and prevent it being pulled away from its location on the rotor by the opening cutter-fuser jaws.

21 Claims, 14 Drawing Sheets

U.S. PATENT DOCUMENTS

| | | | | |
|---|---|---|---|---|
| 5,400,568 | | 3/1995 | Kanemitsu et al. . | |
| 5,461,845 | * | 10/1995 | Yeager | 53/451 |
| 5,519,982 | * | 5/1996 | Herber et al. | 53/139.2 |
| 5,557,907 | * | 9/1996 | Malin et al. | 53/139.2 |
| 5,660,479 | | 8/1997 | May et al. . | |
| 5,672,009 | | 9/1997 | Malin . | |
| 5,816,018 | * | 10/1998 | Bois | 53/139.2 |

* cited by examiner

Fig. 3
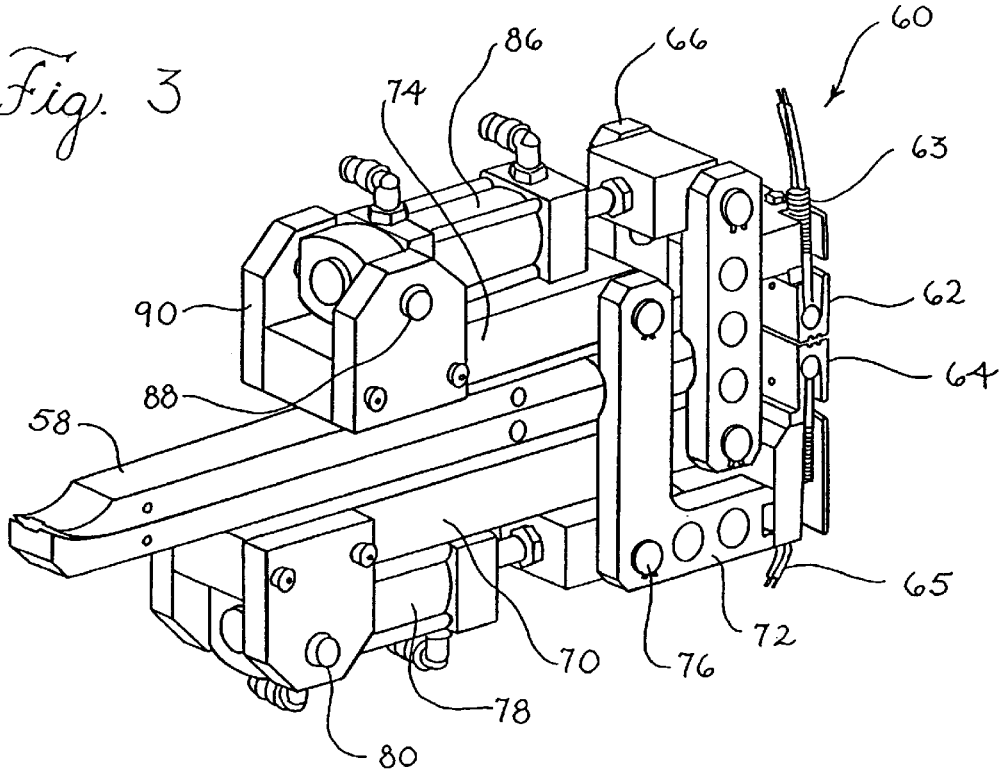
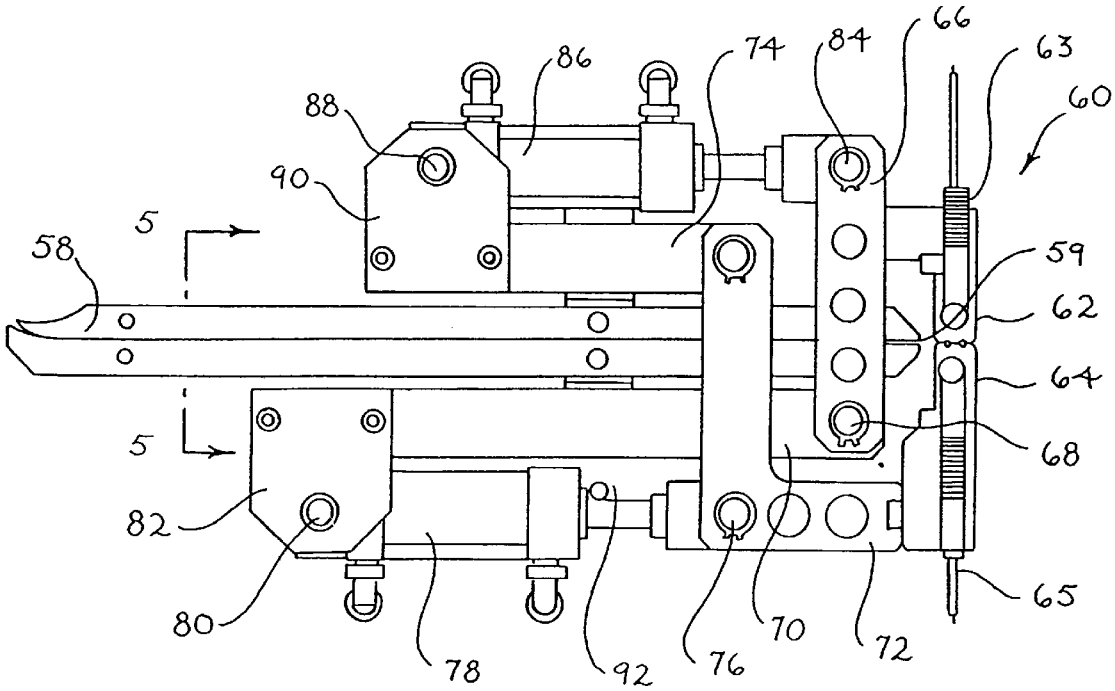
Fig. 4

ZIPPER SEALER MACHINE

This application is a division of U.S. patent Application No. 09/164,611 filed Oct. 1, 1998, now U.S. Pat. No. 6,021,621 which issued Feb. 8, 2000, which is a continuation-in-part of U.S. Letters Pat. No. 6,012,264 which is based on U.S. patent Application No. 09/056,583 filed Apr. 7, 1998, now U.S. Pat. No. 6,012,264 which issued Jan. 11, 2000.

BACKGROUND OF THE INVENTION

The present invention relates to a method and apparatus for applying a reclosable fastener strip to the continuous web of film on a form, fill and seal machine. There are two manufacturing methods for forming reclosable packages on form, fill and seal machines. In one method, the reclosable fastener strip extends parallel to the feed direction of the continuous web of film. In the second method, the reclosable fastener strip extends transverse to the feed direction of the continuous web of film. The present invention relates to the method in which the reclosable fastener strip extends transverse to the feed direction of the continuous web of film. It is important in forming reclosable packages using this method that the timing of the cross sealing-jaws be coordinated with the position at which the reclosable fastener strip was bonded to the continuous web of film. U.S. Pat. No. 4,655,862 discloses a mechanism for cutting, locating and securing a flexible plastic reclosable fastener strip across the longitudinal axis of the continuous web of film that is being used to create a package having a reclosable top.

U.S. Pat. No. 4,909,017 discloses a machine for making bags that have a reclosable fastener on a form, fill and seal machine. The bag forming process disclosed in this patent includes the step of securing a reclosable fastener strip to the film such that it extends transverse to the direction of film feed. In both U.S. Pat. Nos. 4,655,862 and 4,909,017, a continuous web of film is fed to the form, fill and seal machine from a film roll. Prior to reaching the form, fill and seal machine, a reclosable fastener strip is attached to the surface of the continuous web of film. The reclosable fastener strips are cut from a continuous ribbon of reclosable fastener material that is provided from a supply roll. The strip is guided to the lateral edge of the continuous web of film and then into a channel member that overlays the film. The use of a conventional cutting clement as suggested in these patents has the disadvantage that the knife blades dull quickly when used on machines that produce upward of a hundred packages per minute. Also, conventional cutting knives get contaminated and dull as a result of the cutting action. The use of conventional cutting knives produce a service problem for machines of this type. A reclosable fastener strip is cut from the continuous ribbon which is then positioned by the channel on the upper surface of the continuous web of film. The lower surface of the reclosable fastener strip is secured to the upper surface of the continuous web of film. These patents disclose systems that require a separate apparatus outside of the form, fill and seal machine for securing the reclosable fastener strip to the film. As a result, there is a long span of film extending from the location outside the form, fill and seal machine where the reclosable fastener strip was bonded to the film to the point where the continuous web of film encounters the forming shoulder.

The continuous web of film from which packages are manufactured is very thin and is difficult to control. For this reason, it is desirable to mount the separate device for bonding the reclosable fastener strip to the continuous web of film close to the form, fill and seal machine that they serve. In fact, they are mounted so close that they may interfere with the normal servicing of the form, fill and seal machine. The long span of continuous film utilized by these machines must be processed and coordinated to assure that the reclosable fastener strip is properly located with respect to where the cross seal of the bag is formed and to assure that it is not damaged as it is moved from the point where it is secured to the continuous web of film to the point where it encounters the forming shoulder.

In addition, these prior art machines must complete the feeding, severing to length and bonding of the segment of reclosable fastener strip to the film before this sequence for the next segment can begin. Thus, the speed of the form, fill and seal machine that has been retrofitted with the prior art machines disclosed in these prior art patents is very limited. Also, in the prior art machines, the two halves of the reclosable fastener strip are not positively interconnected and, thus, could separate from each other or shift relative to each other during the subsequent package forming procedure.

SUMMARY OF THE INVENTION

Applicant has provided a mechanism that advances a length of reclosable fastener material from a continuous supply to a rotor that is mounted adjacent to the film to which a reclosable fastener strip is to be bonded. The advanced length of reclosable fastener material is held on the rotor and then the cutter fuser mechanism is activated to cut a strip from the continuous supply. Before the cutter-fuser jaws begin opening, a flange of the strip of reclosable fastener material is clamped by a brake mechanism to prevent the strip from being pulled away by the opening jaws. The rotor is then rotated 180° to bring the reclosable fastener strip to the location at which it will be bonded to the film. A flange of the reclosable fastener strip is grasped and the rotor is rotated an additional small amount which serves to release the reclosable fastener strip from the rotor. The rotor is then rotated in the reverse direction to thus properly locate its edge to receive the next length of reclosable fastener material.

It is important, for two reasons, that the reclosable fastener material be cut and fused the instant that it is in its final position on the rotor. First, the cutting and fusing jaws are at a temperature that, if the reclosable fastener material is stationary between the open jaws for even a short period, the two halves of the reclosable fastener material could be distorted and stick to the die and create problems in targeting the rotor track for the next feed cycle. Second, if the reclosable fastener material stands stationary at the point at which it is positioned to be cut and fused, this stationary period is added to the cycle time for producing a package on the machine. Cycle time must be kept to a minimum to maximize machine production. Since the micro-processor activates the cutter-fuser, we know precisely when activation of the cutter-fuser occurs. However, after activation there is a time period required for the cutter-fuser jaws to become fully closed. It is important to determine what this time period is. Likewise, since the micro-processor activates the cutter-fuser mechanism to open the jaws, we know precisely when this activation occurs. If the rotor carrying the reclosable fastener strip is rotated before the cutter-fuser jaws begin to open, the just severed end of the reclosable fastener strip is still clamped between the closed jaws and proper rotation of the rotor could not occur.

A jaw position sensor has been provided to sense when the cutter-fuser jaws are fully closed and when they begin to open. The sensing device is directed at the edge of a link for one of the jaws. As the jaws are closing and the sensor recognizes the edge of the link, a signal is sent to the central processor indicating that the jaws are fully closed and the strip has been severed after a set duration time. Likewise, when the jaws start to open, the sensor that is directed to the edge of the link does not see the edge anymore and sends a signal indicating that the jaws are opening. Thus, a single sensing device is used to determine when the cutter-fuser jaws begin to open and when they are fully closed. This jaw position sensor provides the information necessary to sever and fuse the reclosable fastener material as soon as it has reached its final position on the rotor and to rotate the rotor as soon as the severed strip of reclosable fastener material has been released.

Immediately following the closing of the cutter-fuser jaws to sever the reclosable fastener material, the jaws are opened. Since the cutter-fuser jaws are heated, it is possible that some sticking of the reclosable fastener strip to the jaws could occur. An air cylinder brake mechanism is provided to prevent the severed strip of reclosable fastener material that may stick to the jaws from being pulled away from the rotor as the jaws open. The air cylinder brake mechanism clamps the exposed flange of the reclosable fastener strip. The air cylinder brake holds the severed strip of reclosable fastener material in place while the jaws are opening and continues to hold it as the rotor begins to rotate. As the rotation of the rotor progresses, the clamped flange of the reclosable fastener strip is pulled from the air cylinder brake. It has been found that a firm and positive brake mechanism is necessary to perform this function. For this reason, an air cylinder carried by a top block having a rod that extends into the bore of a plunger is utilized. The plunger slides in a bore formed in the top block. The plunger has a flat bottom surface that protrudes from the bore and engages the upper surface of an exposed flange and locks it against a flat surface of a bottom block.

Applicant, in accordance with this invention, advances the continuous supply of reclosable fastener material a small amount at a relatively slow pace during the period in the cycle when the rotor is rotating a small amount to release the reclosable fastener strip from the rotor and then reversing the small amount of rotation. This pre-feeding of the severed end of the continuous supply that moves to the receiving edge of the rotor while the rotor is maneuvered into position to receive the reclosable fastener material locates the severed end of the continuous supply at a point where it lightly engages the receiving edge of the rotor. When the maneuvering of the rotor is completed, the reclosable fastener material is fed to its final position on the rotor at a faster pace. This reduces the time that it will take to complete the process of feeding of the reclosable fastener material to its final position on the rotor. The second phase of this feeding process is accomplished at a pace that is considerably faster than the relatively slow pre-feeding pace. This feature of applicants invention is another step in minimizing the cycle time for producing a package and assuring proper targeting of the zipper with the rotor track.

Still another advantage of applicant's device is that the severing and fusing of the reclosable fastener strip is done by upper and lower cutting and fusing jaws that have smooth engaging surfaces that do not become dull and require replacement as do cutting knifes or blades. It is also important that the two halves of the reclosable fastener material be fused along the cut edges to prevent a shift of the halves of the zipper and limit leakage from the filled package. However, the fusing should be limited to the immediate area of the severed end and not extend longitudinally beyond the immediate area since that would shorten the effective length of the zipper. This is accomplished in the embodiment of the cutting and fusing jaws disclosed herein by the provision of a cutting tip that has an arcuate cross section and by the provision of relief areas adjacent the severing and fusing surfaces of the cutting and fusing jaws to minimize exposure to heat particularly in the flange areas of the reclosable fastener material. All surfaces of the jaw are provided with a coating to minimize sticking of the fastener to the jaws.

During the operation of a form, fill and seal machine, there are occasions when it is necessary to stop the machine operation for short periods, for example to make minor adjustments to the operating conditions. The cutting and fusing jaws take some time to cool and when the machine is stopped, the heat from the jaws could cause the short section of reclosable fastener material that is positioned within the cutter-fuser mechanism to be distorted and stick to the die. To avoid this, a stand-by mode has been developed that automatically retracts this short section of reclosable fastener material into the horizontal track from which it protrudes. The horizontal track shields the reclosable fastener material and prevents it from soaking up heat from the cutter-fuser jaws which could cause the material to be distorted and stick.

BRIEF DESCRIPTION OF THE DRAWINGS

FIG. 3 is a perspective view of the cutter-fuser mechanism.

DETAILED DESCRIPTION OF THE INVENTION

Figure 1:
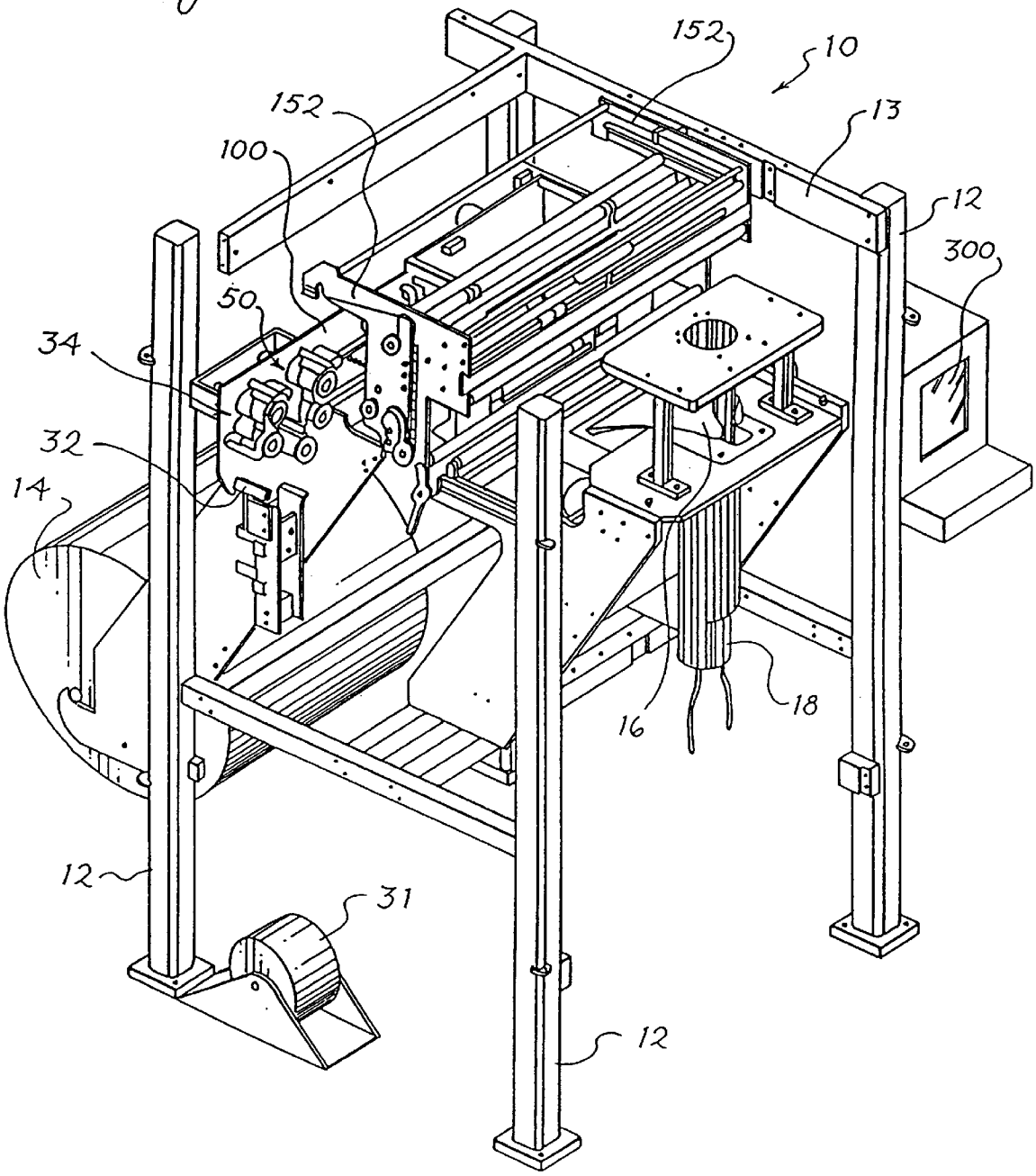
FIG. 1 is a perspective view of a form, fill and seal machine having the zipper sealer device of this invention mounted thereon.

This invention could be used with any commercially available form, fill and seal machine, such as the machine disclosed in U.S. Pat. No. 5,715,656, that issued on Feb. 10, 1998. U.S. Pat. No. 5,715,656 is hereby, by reference, made a part of this disclosure. There is shown in FIG. 1 a form, fill and seal machine 10 of the type disclosed in U.S. Pat. No. 5,715,656. In FIG. 1, portions of the conventional form, fill and seal machine 10 have not been shown in order to better illustrate the invention of this application. The form, fill and seal machine has a frame including four posts 12 and horizontal members 13. The film for forming packages on machine 10 is carried by a film roll 14. The film that is dispensed from the film roll 14, as is fully disclosed in U.S. Pat. No. 5,715,656, follows a circuitous route over a film guide mechanism that includes a series of rollers. After winding through the film guide mechanism the film is fed to the forming shoulder 16 which causes the film to be wrapped around the forming tube 18. The forming tube 18 shapes the film into a continuous longitudinal tube that is sealed by a longitudinally extending device. A central processing unit 300 for the form, fill and seal machine is shown in FIG. 1.

The form, fill and seal machine includes cross sealing jaws (not shown) that produce a cross seal that will be the bottom seal for the next package to be produced and a top seal for the package just completed. Between this bottom and top seal there is a knife that separates the package just completed from the next package to be produced. The cross scaling jaws also produce a line of perforations that extend across the top of the package below the top seal. Below this line of perforations the cross scaling jaws seal the remaining two flanges of the reclosable fastener strip material to the inside surface of the package. The consumer can then remove the top seal along the line of perforations and then use the reclosable fastener strip to reclose the package. The cross scaling jaws used in this invention are not conventional but form no part of this invention.

Figure 5:
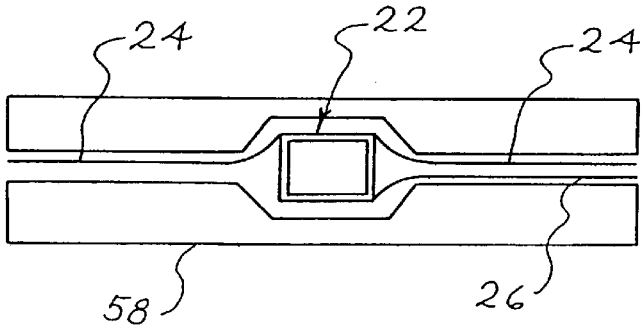
FIG. 5 is a cross section view of the horizontally oriented track taken along lines 5—5 of FIG. 4.

The interlocked reclosable fastener material 22 is supplied as a continuous strip or ribbon from a roll 31 shown in FIG. 1. The reclosable fastener material preferably consists of two halves that are interlocked before being placed on the roll 31. As best seen in FIG. 5, the upper half of the interlocked reclosable fastener strip has a mounting flange 24 extending from both sides and the bottom half has a single or dual mounting flange 26 extending from one or both sides.

Figure 2:
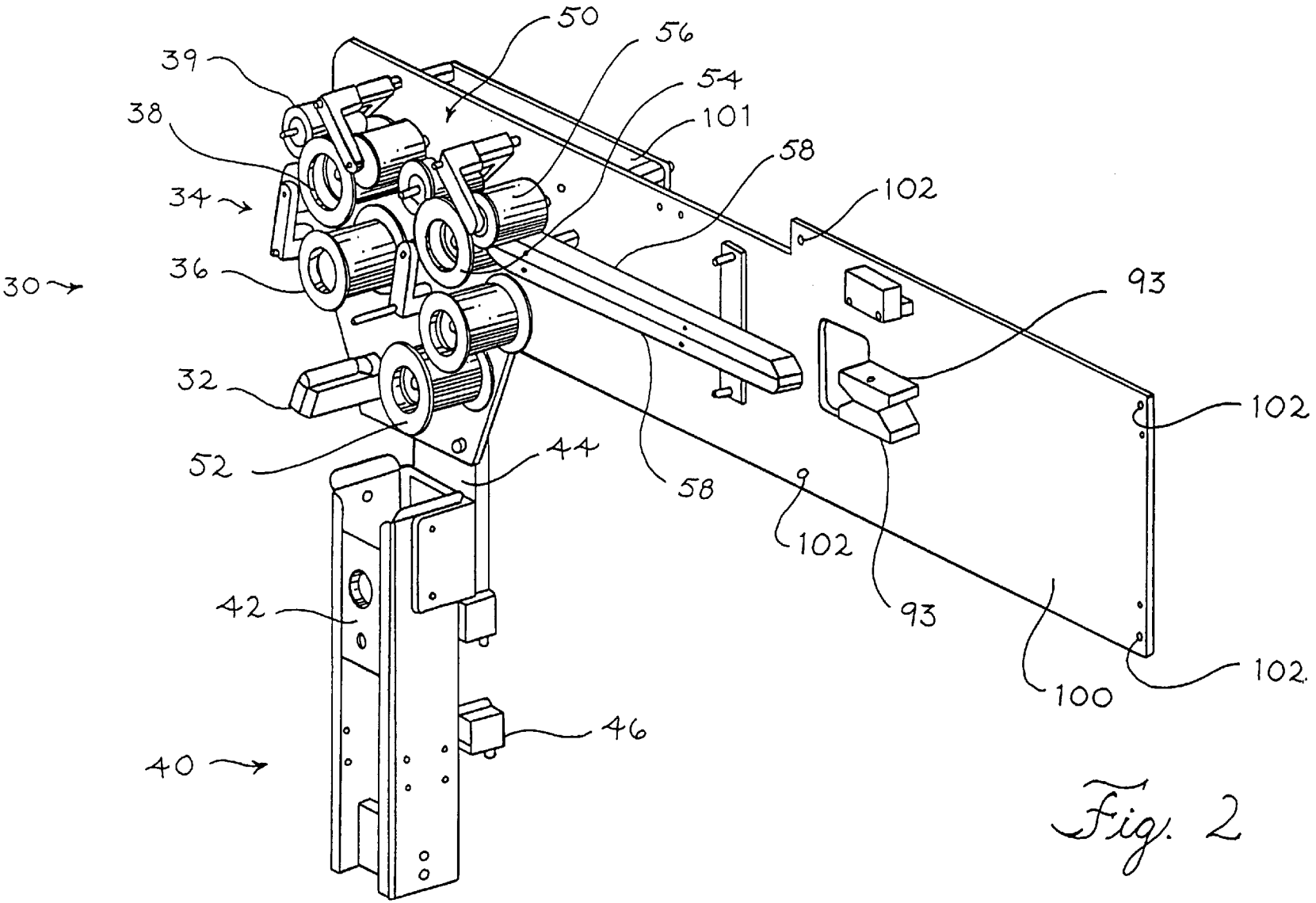
FIG. 2 is a perspective view of reclosable fastener mechanism feeder assembly.

The reclosable fastener material travels from the roll 31 to a reclosable fastener feeding mechanism generally designated 30, as shown in FIG. 2. The components of the reclosable fastener feeding mechanism are mounted on a mounting plate 100. The reclosable fastener material 22 enters the feeding mechanism 30 through an eyelet 32, from which it extends upward to the primary feeder 34. From eyelet 32 reclosable fastener material 22 extends around spool 36 and over the top of the driven roll 38, in the primary feeder 34. The driven rolls 38 and 54 are driven by stepper motors 35, see FIG. 8, carried on a stepper motor mounting plate 101 that is secured to the back surface of mounting plate 100. Spring-biased pressure rollers 39 bias the reclosable fastener material into engagement with drive roll 38.

The reclosable fastener material 22 extends from the primary feeder 34 down into the dancer 40 where it wraps around a roll carried by a slide member 42. The dancer 40 is a vertically extending trough like device that is supported on the mounting plate 100 through a dancer support plate 44. The slide member 42 and the roll carried thereby is free to reciprocate in the trough-like structure of the dancer 40. The slide member 42 function to retain the dancer roller in proper orientation in the trough-like structure. When the sliding dancer roller moves down, as a result of reclosable fastener material being fed to it by the primary feeder 34, a reserve of reclosable fastener material 22 is stored in the dancer 40 which enables the secondary feeder 50 to quickly draw up the reserve of reclosable fastener material from the dancer 40.

A proximity-type electric eye 46 is carried by the dancer 40 which recognizes the dancer roller when it reaches the bottom of the dancer 40. When the presence of the dancer roller is recognized by electric eye 46, power to the stepper motor that drives the primary feeder 34 is turned off. When the secondary feeder 50 draws off the reserve of reclosable fastener material stored in the dancer 40, the dancer roller moves up and contact with electric eye 46 is broken. When this contact is broken a signal is sent to the stepper motor driving the primary feeder 34 which causes more reclosable fastener material to be drawn from the supply roll 31 and fed to the dancer 40.

The secondary feeder 50 includes two guide roll 52 and a driven roll 54. Spring biased pressure rollers 56 bias the reclosable fastener material into engagement with drive roll 54. The reclosable fastener material 22 is measured and fed by the secondary feeder 50 into a horizontally oriented track 58. The track 58 feeds the reclosable fastener material 22 to a reclosable fastener cutter-fuser mechanism generally designated 60, in FIGS. 3 and 4.

Figure 7:
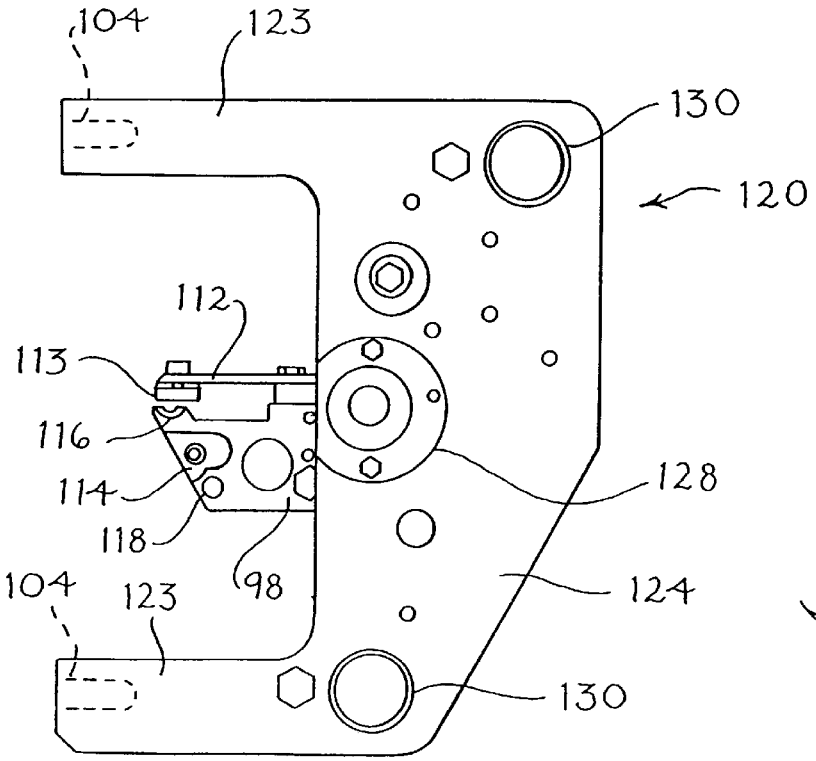
FIG. 7 is an end view of the rotor carriage mechanism.
Figure 11:
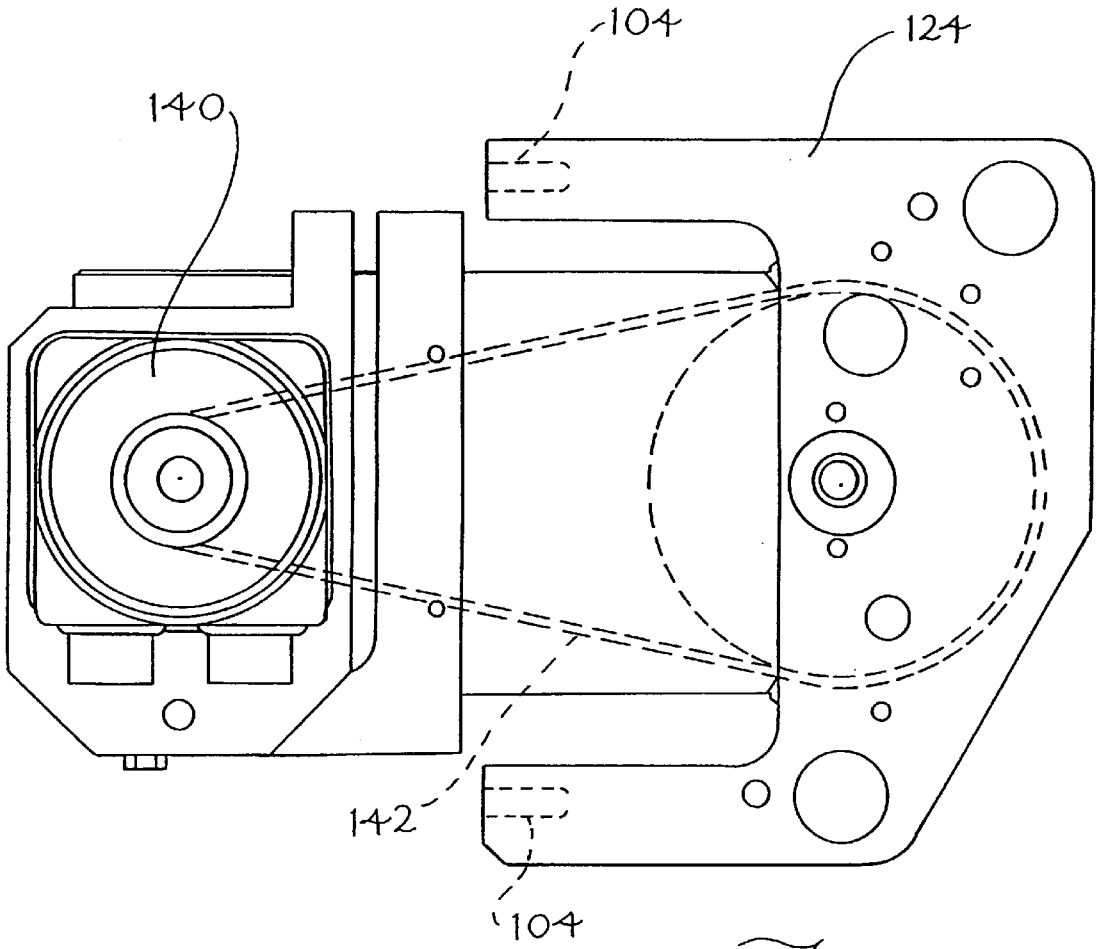
FIG. 11 is a side view of the rotor motor drive from the inside of the rotor carriage.
Figure 13:
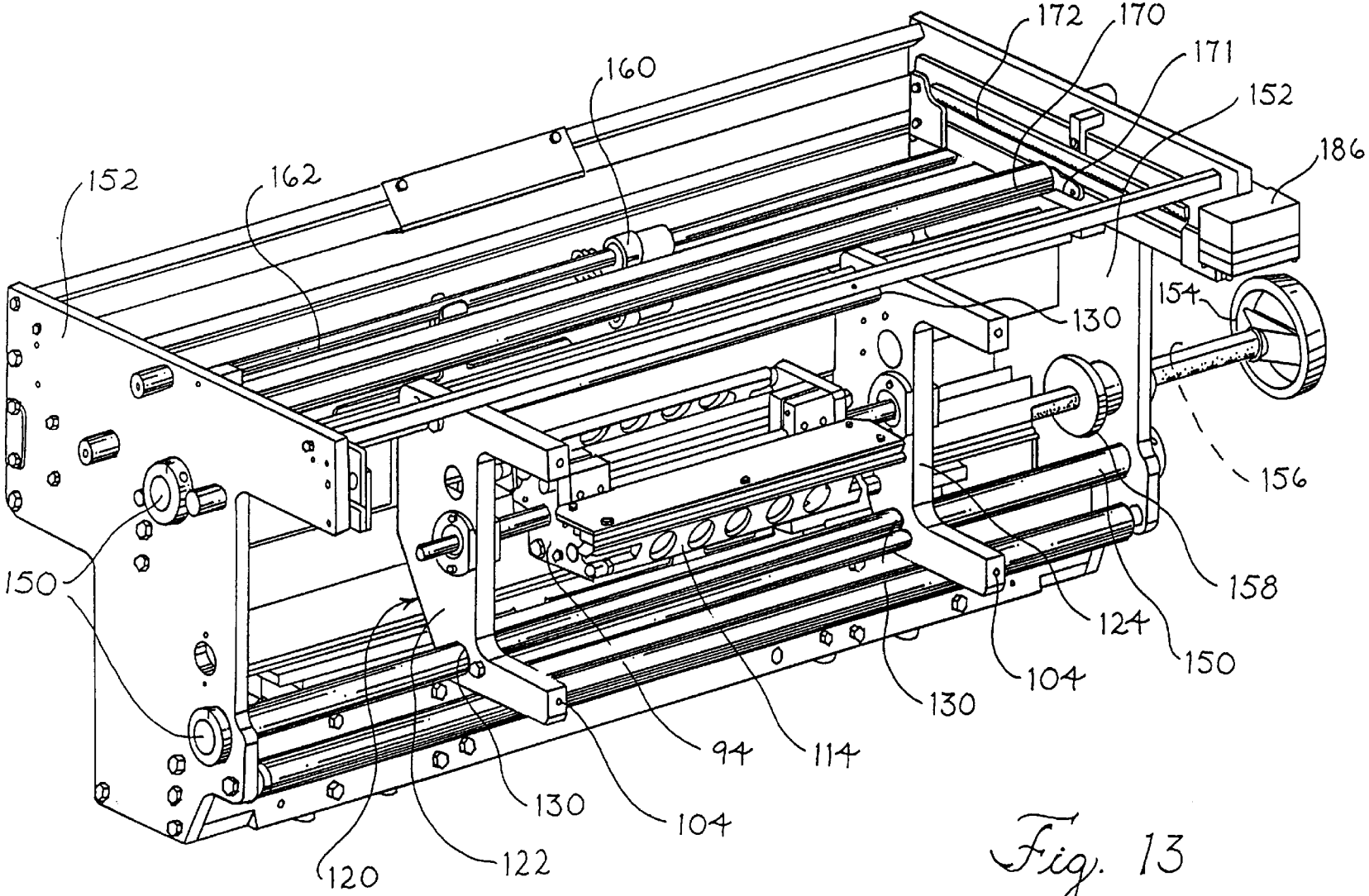
FIG. 13 is a perspective view, from the upper rear, of the reclosable fastener mechanism placement assembly and zipper sealer assembly.

It should be noted at this point that the apertures 102 formed in mounting plate 100 as shown in FIG. 2 will receive machine screws that are threaded into threaded holes 104 best seen in FIGS. 7, 11 and 13. Through this connection the rotor carriage 120 and the mounting plate 100 are combined to form the zipper sealer machine chassis that carries all components of the zipper sealer machine. The zipper sealer machine chassis can move laterally as a unit.

The reclosable fastener cutter-fuser 60 is best shown in FIGS. 3 and 4. The horizontally oriented track 58 extends through the center of the reclosable fastener cutter-fuser 60. The reclosable fastener material exits the horizontally oriented track 58 through its end 59. The end 59 is located at the juncture of the upper 62 and lower 64 cutter-fuser jaws. As the reclosable fastener material 22 is fed out the end 59 of the track 58 the reclosable fastener jaws are open so that appropriate length of reclosable fastener material 22 can be metered through the opening formed by the engaging surfaces 600, 602 of jaws 62, 64. The jaws 62, 64 include electric heating elements 63, 65 respectively that when energized cause the engaged jaws to both sever and fuse the cut ends of the fastener strip 22.

After closing the jaws 62, 64 the severed ends of the reclosable fastener material are located in the gaps between the engaging surfaces 602, 600 and the two halves of the zipper have been both severed and the ends have been positively fused together. Fusing the ends of the strip of reclosable fastener material insures that the two halves of the reelosable fastener strip will remain interlocked during the package forming process and will not shift relative to each other. Furthermore, in the filled package the fused ends of the reclosable fastener strip prevents leakage from the package that could occur between the two halves of the zipper if they are not fused together at the ends.

The upper jaw 62 is fixed to a pair of links 66, the lower ends of which are pivoted at 68 to a bar 70. The upper ends of links 66 are pivotally connected at 84 to the rod end of a double-acting pneumatic cylinder 86. The head end of the double-acting pneumatic cylinder 86 is pivoted to a clevis 90 carried by an end of bar 74.

When cylinder 86 extends it causes upper jaw 62 to move to the point of contact of jaws 62 and 64 at which it severs the reclosable fastener material and fuses the severed ends of the two halves of the reclosable fastener strip to each other. When cylinder 86 retracts it causes upper jaw 62 to move up and back away from the point of contact of jaws 62 and 64.

The lower jaw 64 is fixed to one pair of the free ends of a pair of L-shaped levers 72. The other free ends of L-shaped levers 72 are pivoted to a bar 74. The juncture of L-shaped levers 72 is pivotally connected at 76 to the rod end of a double acting pneumatic cylinder 78 which is pivoted at 80 to a clevis 82 carried by bar 70.

When cylinder 78 extends, which is at the same time that cylinder 86 extends, it causes lower jaw 62 to move to the point of contact of jaws 62 and 64 at which it severs the reclosable fastener material and fuses the severed ends of the two halves of the reclosable fastener strip to each other. When cylinder 78 retracts, which is at the same time that cylinder 86 retracts, it causes lower jaw 64 to move down and back away from the point of contact of jaws 62 and 64.

As best seen in FIG. 4, a vertically extending bar 92 that is secured to bars 70 and 74 as well as the horizontally oriented track 58 functions to fix these elements to mounting plate 100 at locations spaced therefrom.

The reason for this elaborate design for opening and closing jaw 62 and 64 is twofold. When pneumatic cylinder 86 is contracted, the upper jaw 62 is moved in an arc shaped path up and back toward the cylinder 86. Also, when the pneumatic cylinder 78 is contracted, the lower jaw 64 moves in an arc shaped path down and back toward the cylinder 78. These movement paths accomplish two things. First, it is a more effective way of separating the jaws 62 and 64 from the reclosable fastener strip material 22 than if they moved vertically up and down since the arc paths peel the jaws 62, 64 off of the fused reclosable fastener strip material. Second, it moves the jaws 62 and 64 away from the severed end of the reclosable fastener strip material to permit the severed piece of reclosable fastener strip material to be rotated. As shall be discussed further below, it is necessary that the jaws 62, 64 open to a position at which they will not interfere with the end of the section of reclosable fastener strip material that has just been severed and fused because the reclosable fastener strip will be rotated 180 degrees.

It is important that the reclosable fastener material 22 be cut and fused the instant that feeding it into position is completed for two reasons. First, the cutting and fusing jaws are at an elevated temperature such that if the reclosable fastener material is stationary between the open jaws for even a short period, the flanges of the reclosable fastener material could be distorted and stick to the jaw and, thus, cause problems in targeting the rotor. Second, if the reclosable fastener material remains stationary at the point at which it is positioned to be cut and fused, this stationary period is added to the cycle time for producing a package on the machine. Since the micro processor activates the cutter-fuser we know precisely when activation occurs, however there is a time period after activation until the cutter-fuser jaws are actually closed. It is important to determine what that time period is. Likewise, since the micro processor 300 activates the cutter-fuser mechanism 60 to open the jaws we know when this activation occurs. However, it is important to know precisely when the jaws actually begin opening. If the rotor 112 carrying the reclosable fastener strip 22 is rotated before the cutter-fuser jaws 62, 64 have began to open, the just severed end of the reclosable fastener strip would still be clamped between the closed jaws and it would not be free to rotate with the rotor. For this reason the rotor 94 cannot be rotated until the cutter-fuser jaws have actually began to open. A sensing device 700 has been provided to sense when the cutter-fuser jaws are fully closed and when they begin to open. The sensing device 700 is directed at the edge of a link, that functions to open and close one of the jaws. Thus, a single sensing device 700 is used to determine when the cutter-fuser jaws arc both fully closed and when they begin to open.

The sensor 700 is needed so that we know when the cutting and fusing jaws 62, 64 jaws are fully closed and begin to open so that other mechanisms of the machine can be actuated at precisely the right momentum. The sensor 700 functions to tell us when the cutter-fuser jaws become fully closed and when they begin to open, which makes it possible to calculate the time period required for the jaws 62, 64 to actually begin opening and to be fully closed from the time that the activating signals are sent. Since we know how much time is needed for the feeder to feed the zipper and we can now calculate how much time is needed for the cutter-fuser to begin opening from the time that it is activated, it can now be calculated when the cutter-fuser mechanism must be activated to insure that the reclosable fastener material is severed and fused at the precise instant that it reaches it final destination on the rotor 94. Likewise we also have the necessary data to determine precisely when the rotor 94 can be activated knowing that the cutter-fuser jaws have begun opening and thus the severed strip of reclosable fastener material has been released and is free to rotate with the rotor. The sensor 700 enables us to determine the precise time that the jaws 62, 64 begin to open and are fully closed.

Figure 4A:
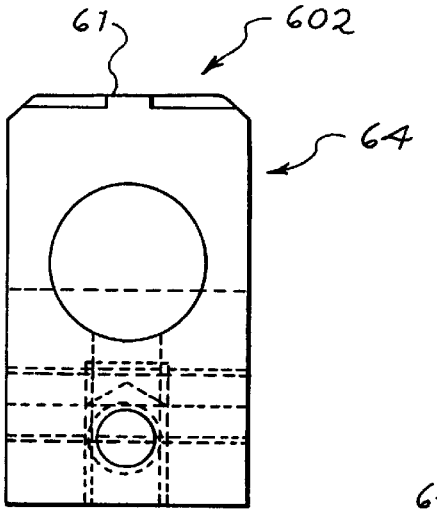
FIG. 4A is an end view of the lower cutting and fusing jaw.
Figure 4B:
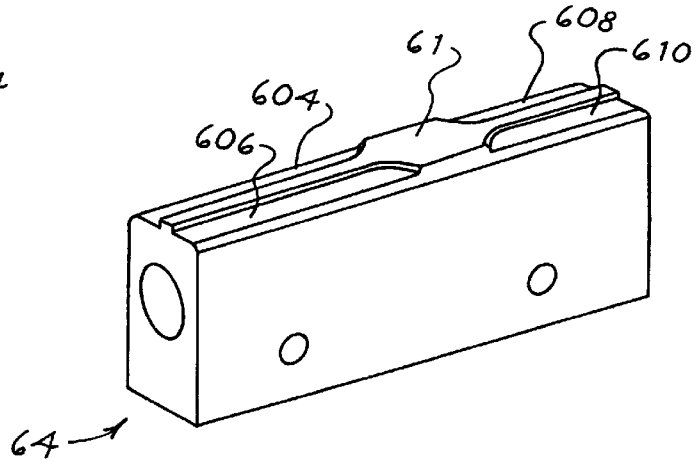
FIG. 4B is a perspective view of the lower cutting and fusing jaw.
Figure 4C:
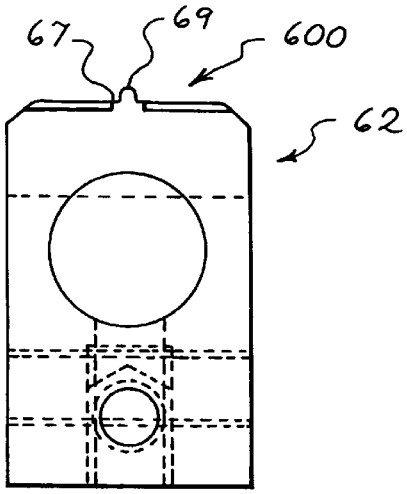
FIG. 4C is an end view of the upper cutting and fusing jaw.

The preferred embodiment of the severing and fusing surfaces for jaws 62 and 64 is illustrated in FIGS. 4A through 4D which are enlarged views. In FIG. 4A and 4B lower jaw 64 has an engaging surface 602 that includes a flat severing and fusing surface 61 and in FIGS. 4C and 4D the upper jaw 62 has an engaging surface 600 that includes a severing and fusing surface 67 including a raised ridge 69 having a smooth edge having an arcuate cross section shape. Raised ridges 69 define the cutting line along which the reclosable fastener material is severed. The longitudinal extent of the engaging surfaces 600 and 602 are oriented such that they are transverse to the longitudinal extent of the reclosable fastener strip material. The flat severing and fusing surfaces 61 of the lower jaw 64 is spaced about 0.0020 of an inch from the lowest point on the raised ridge 69 of the upper jaw 64 when the jaws 62, 64 are fully closed and severing occurs. Thus, the severing and fusing surfaces 61 and 67 do not actually engage when the jaws 62 and 64 are fully closed. As a result of the severing and fusing surfaces not making contact these surfaces have a long service life and require little service attention. The raised ridge 69 approaches the lower flat severing and fusing surface 61 when the jaws 62 and 64 close and function to sever the reclosable fastener material 22 and fuses the both severed ends of the reclosable fastener material 22.

Figure 4D:
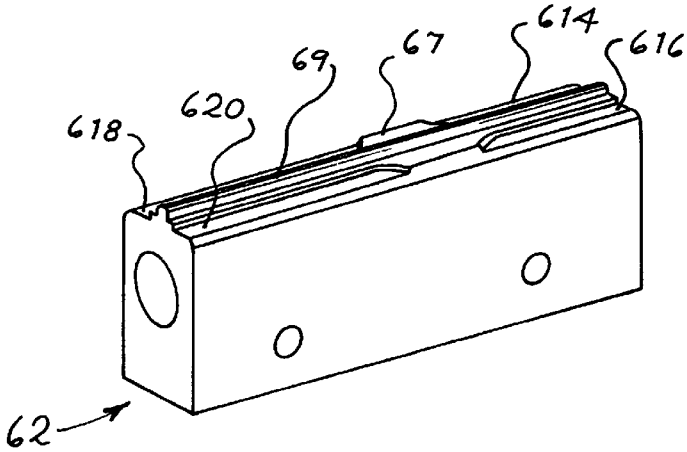
FIG. 4D is a perspective view of the upper cutting and fusing jaw.
Figure 4E:
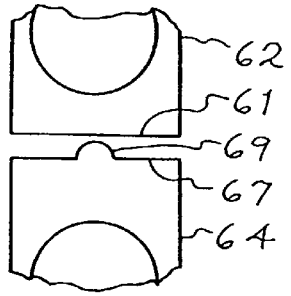
FIG. 4 is a side view of the cutter-fuser mechanism.

Relief areas 604, 606, 608 and 610 are formed in the engaging surface 602 of lower jaw 64. Corresponding relief areas 614, 616, 618 and 620 are formed in the engaging surface 600 of upper jaw 62. The corresponding relief areas formed in engaging surface 602 and 600 results in providing a considerable gap between the corresponding relief surfaces in engaging surface 600 and 602 when jaws 64, 62 are fully closed. The relief areas are located such that they correspond with the flange portions of the reclosable fastener material 22. The flanges are very thin and thus could be fused by less heat than would be required to fuse the thicker zipper area of the reclosable fastener material 22. The portions of the engaging surfaces 602 and 600 that do not have relief areas are aligned with the zipper portion of the reclosable fastener material 22. In FIGS. 4B and 4D the relief areas 604, 606, 608 and 610 are longer than relief areas 608, 610, 618 and 620. This difference in length is provided to accommodate the specific reclosable fastener material 22 that is currently being used with applicants machine. The specific reclosable fastener material currently being used on applicants machine, see FIG. 5, has long engaging flanges 24, 26 extending from both halves of the zipper material and a single short flange 24 extending from one of the halves. The longer relief areas 604, 606, 614 and 616 are aligned with the longer double flanges 24, 26 and the shorter relief areas 608, 610, 618 and 620 are aligned with the shorter single flange 24. It should be understood that according to applicant's invention the relief areas need not be as illustrated herein but rather would be made to accommodate the specific reclosable fastener material being used.

A non-stick coating material, such as TEFLON is applied to the surfaces to prevent the flanges of the reclosable fastener material from sticking to these area and to assure a clean separation of the jaws 62, 64 from the reclosable fastener material 22 after severing and fusing.

Figure 6:
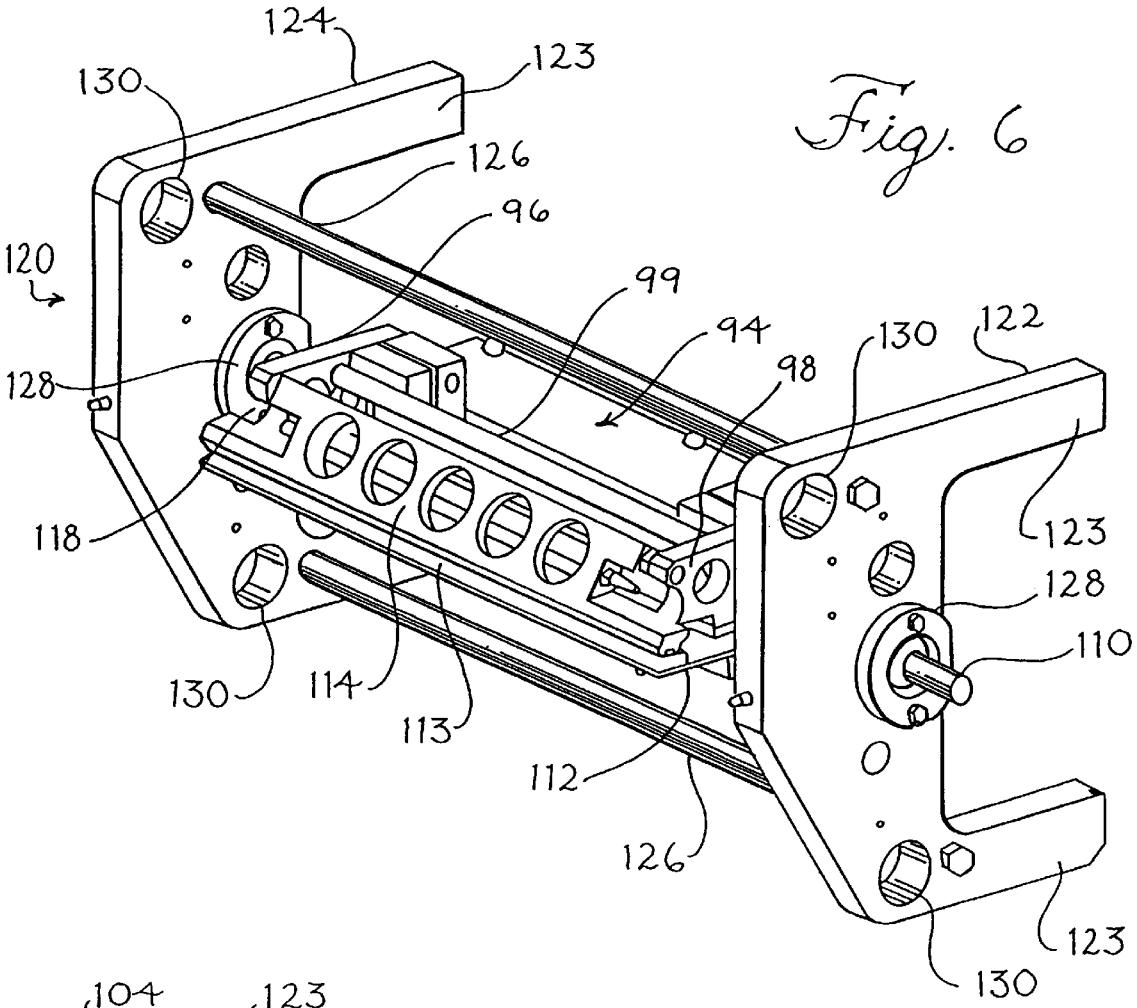
FIG. 6 is a perspective view of the rotor and rotor carriage mechanism.

Referring now to FIGS. 6 and 7, a rotor 94 is located relative to the cutter-fuser mechanism 60 such that it receives the major portion of the reclosable fastener material 22 that is metered through the end 59 of the horizontally oriented track 58. The metered section of reclosable fastener material 22 is then held on the rotor 94 while the cutter-fuser mechanism 60 is actuated. Since the cutter-fuser jaws 62, 64 are located a short distance from the edge of rotor 94, the reclosable fastener strip has a tail, equal in length to this short distance, that extends beyond the edge of rotor 94. The rotor 94 includes a pair of end plates 96 and 98 connected by a reinforcing rod 99. A rotor shaft 110 is fixed to end plates 96 and 98 and extends outwardly therefrom. The two halves of the rotor 94 are substantially symmetrical about its rotor axis which is defined by shaft 110. Referring to the left half as seen in FIG. 6, a flat plate 112, having an outer edge 113, is secured at its ends to end plates 96, 98. As shown in FIG. 7, a resilient holding mechanism 114 that can be spring biased has a track 116 formed along its edge that engages flat plate 112. The resilient holding mechanism 114 is pivotally mounted at 118 to the end plates 96, 98. In FIG. 7 the resilient holding mechanism 114 is spring biased into engagement with the bottom surface of flat plate 112. The outer edge 113 of flat plate 112, in FIG. 7, is spaced away from the film course, since this is the location where the reclosable fastener material 22 is received by the rotor.

The end of reclosable fastener material is fed from the end 59 of horizontally oriented track 58 into the track 116 formed in resilient holding mechanism 114 and biased into engagement with the bottom surface of flat plate 112. The track 116 extends the entire length of the resilient holding mechanism 114. The interlocked portion of the reclosable fastener material 22 lies in the track 116 and the flanges 24 and 26 of the reclosable fastener material 22 extend under the portions of the spring biased hold down device that bears against flat plate 112. The side of the reclosable fastener material 22 having only flange 24 (see FIG. 5) is located along the outer edge 113 of flat plate 112 and extends beyond the outer edge 113.

Immediately following the reclosable fastener material 22 being positioned in track 116 of the rotor 94 and being severed by the cutter-fuser mechanism 60, an air cylinder brake 93, see FIGS. 2, 17, 18 and 19, is activated. Air cylinder brake 93 clamps the exposed flange 24 of the reclosable fastener strip 22 so that when the jaws 62 and 64 open there is no undesirable effect on the reclosable fastener strip, such as pulling it back. Jaws 62 and 64 are heated and it is thus possible that some sticking of the reclosable fastener strip to the jaws 62 and 64 could occur. Thus, while the jaws 62, 64 opening, the air cylinder brake 93 holds the severed strip of reclosable fastener material in place. It is not necessary to release the grasp by the air cylinder brake 93 on the flange 24 before rotor 94 begins its rotation. As the rotation of rotor 94 progresses the flange 24 is pulled from the grasp of the air cylinder brake.

Figure 18:
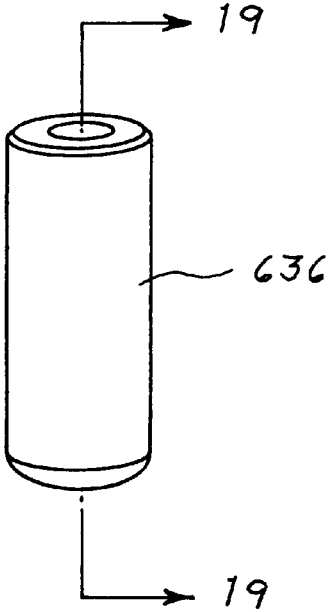
FIG. 18 is a perspective view of the air cylinder brake plunger.
Figure 17:
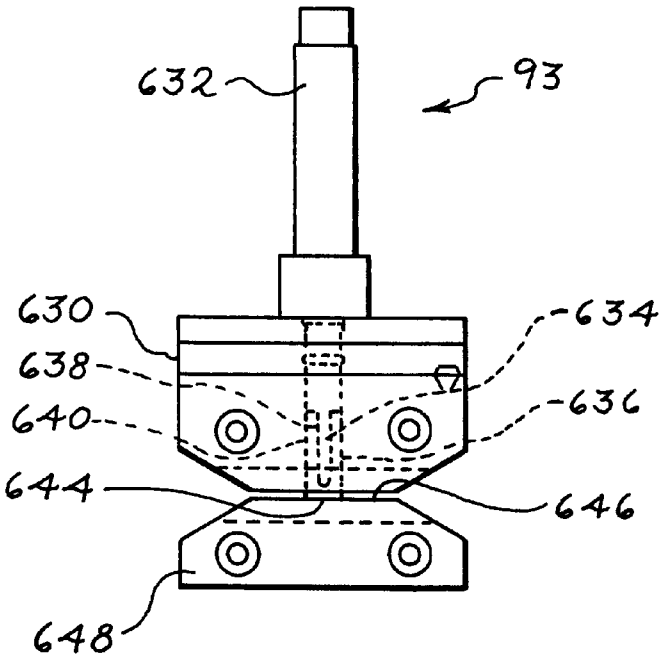
FIG. 17 is an isolated front view of the air cylinder brake.

An isolated view of air cylinder brake 93 is shown in FIG. 17. The air cylinder 632 is mounted in a bore formed in the upper surface of the air cylinder top block 630. The air cylinder rod 634 extends into a bore 638 formed in plunger 636. Plunger 636 slides in bore 640 formed in air cylinder top block 630. Plunger 636 is best seen in FIG. 18 and cross section view FIG. 19. Plunger 636 has a flat bottom surface 644 that protrudes from bore 640 and engages the upper surface of flange 24 and secures it against the flat surface 646 of the air cylinder bottom block 648.

Figure 8A:
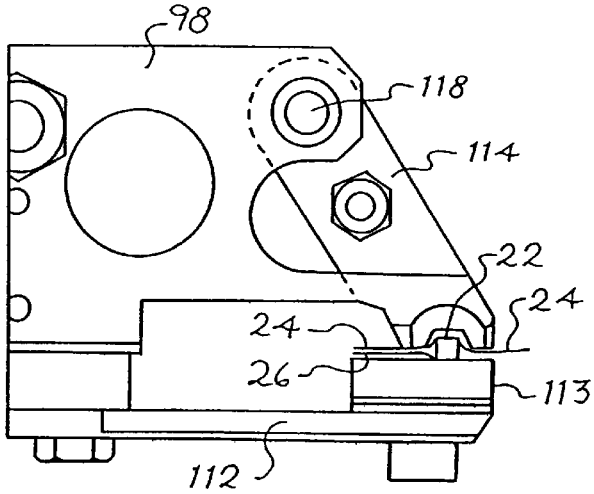
FIG. 8A is an enlarged view of the flat plate of the rotor showing the reclosable fastener strip held by the spring-biased device.
Figure 8:
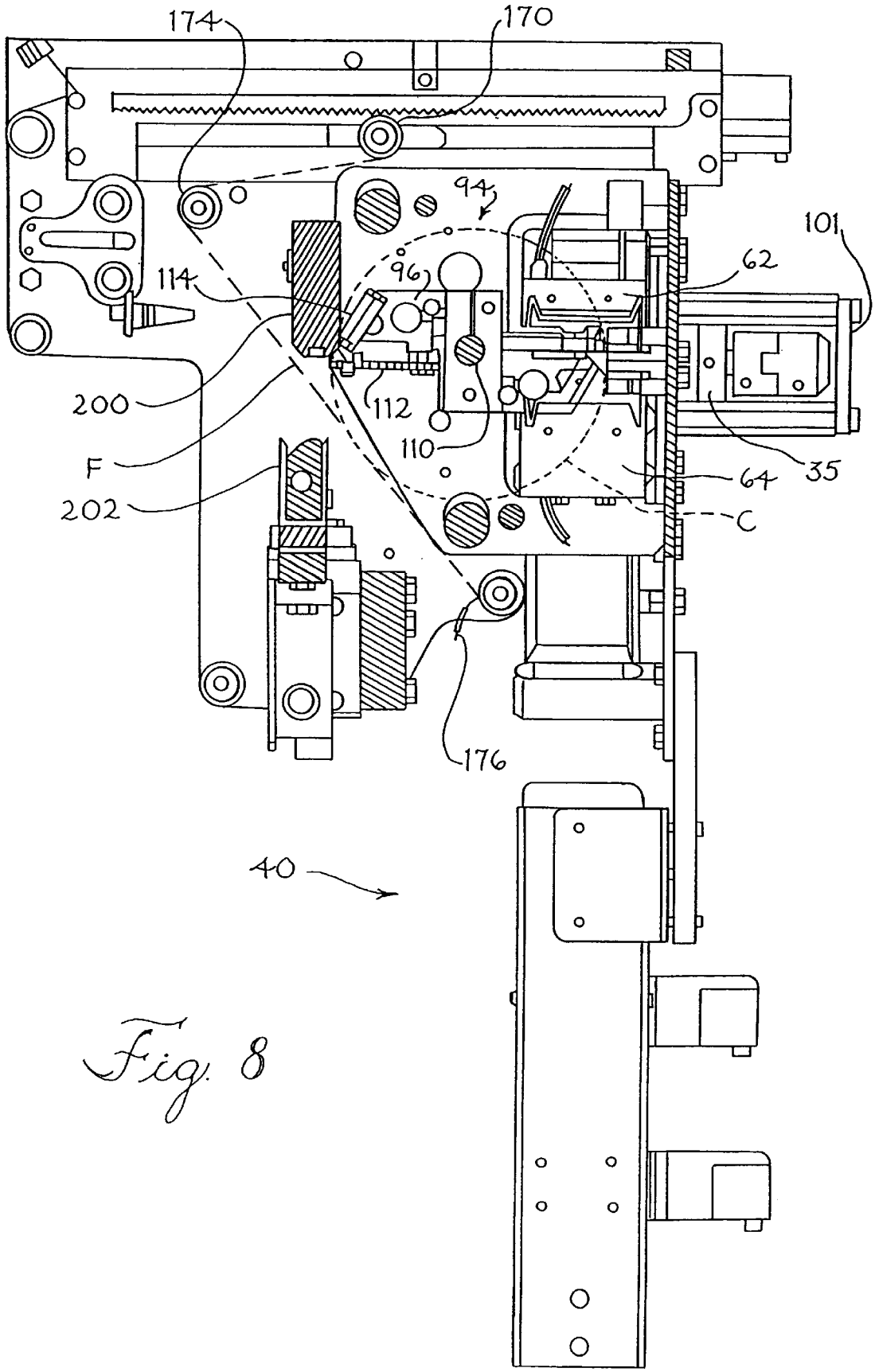
FIG. 8 is an end view of the zipper apparatus.

After the section of reclosable fastener material that has been received by the rotor 94 has been severed, the rotor is rotated 180 degrees which results in the symmetrical sides reversing positions. The left side of the rotor 94, seen in FIG. 7, is seen in FIG. 6, after rotation, with the resilient holding mechanism 114 biased into engagement with the upper surface of flat plate 112. Although not shown in FIG. 6, flange 24 of the reclosable fastener strip protrudes beyond the outer edge 113 of flat plate 112. In FIG. 6, the outer edge 113 is located at a position adjacent to the film course. The severed strip of reclosable fastener material is now at the location at which it will be bonded to the film. This relationship is shown in FIG. 8, in which the course of the film F is seen extending diagonally from roll 174 to roll 176. The diagonal film course passes through the vertical center line extending through an upper bonding member 200 and a lower movable bonding member 202 which together form the bonding mechanism. Also, seen in this view is the rotor 94 that rotates about its rotor shaft 10. The circle designated C, in FIG. 8, represents the path that the outer edges 113 of flat plate 112 defines as the rotor 94 rotates. After being rotated 180 degrees, to the position seen in FIG. 8, the reclosable fastener strip 22 (not shown) is now resting on the upper surface of a flat plate 112, and would be urged downwardly by resilient holding mechanism 114. FIG. 8A is an enlarged view of the flat plate 112 showing the reclosable fastener strip that is being held by the spring biased hold down device 114. This view clearly shows the flange 24 extending beyond the outer edge 113 of the flat plate 112. It should be noted that FIG. 8A is seen from the opposite direction than seen in FIG. 8. At this time in the cycle, the lower bonding member is energized and moves upwardly toward the stationary upper bonding member 200. The lower bonding member 202 encounters the bottom surface of film F as it moves up. As the upward movement continues, the flange 24 of the reclosable fastener strip 22 that is protruding from the outer edge 113 of the flat plate 112 is grasped and held stationary against the upper surface of the film F and the upper bonding member 200. The lower bonding member 202 is biased upwardly resulting in the reclosable fastener strip being held stationary between the upper and lower bonding members 200, 202 of the bonding mechanism. When holding the flange 24 stationary the underlying film is also held. The rotor 94 is then rotated another 6 degrees which causes the reclosable fastener strip 22 to pop out from under the resilient holding mechanism 114. After the reclosable fastener strip 22 has been released from the rotor 94 the rotor 94 is then rotated in the reverse direction to the 180° position to thus properly locate the opposite edge to receive a length of reclosable fastener material from the continuous supply. During the time period that the rotor 94 rotates a small amount to release the reclosable fastener strip and than reverse rotates to return to the original 180° position, the continuous supply of reclosable fastener material is pre-advanced toward the rotor a distance equal to the tail that overhangs the rotor. This reduces the distance that the continuous supply of reclosable fastener material must be advanced and positions the ends of the zipper closer to the track opening in the rotor. The bonding members 200 and 202 of the bonding mechanism then carry out their function to bond the flange 24 of the reclosable fastener strip 22 to the upper surface of the film F.

Referring now to FIGS. 6 and 7, the rotor carriage 120 includes a pair of end plates 122 and 124 that are joined by a pair of spacer bars 126. Each end plate 122 and 124 has an upper and a lower finger like projection 123 and a bushing 128 that receives the rotor shaft 110 of rotor 94. Each end plate 122 and 124 has two apertures formed therein into which arc inserted anti friction slide devices 130. As best seen in FIG. 7, tapped holes 104 are formed in the ends of each of the finger like projections 123. The rotor carriage 120 is secured to mounting plate 100 by screws or the like, that extend through aligned holes 102 and 104 to combine these units into the zipper sealer machine chassis.

Figure 9:
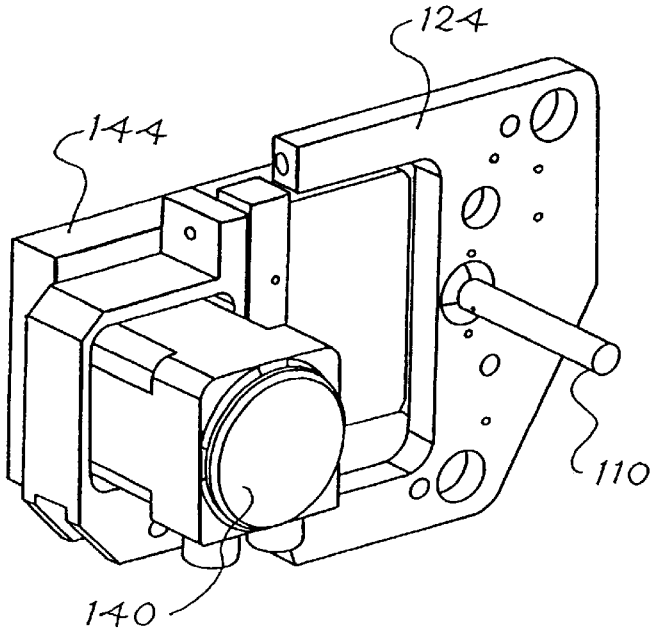
FIG. 9 is a perspective view of the rotor motor drive from the outside of the rotor carviage.
Figure 10:
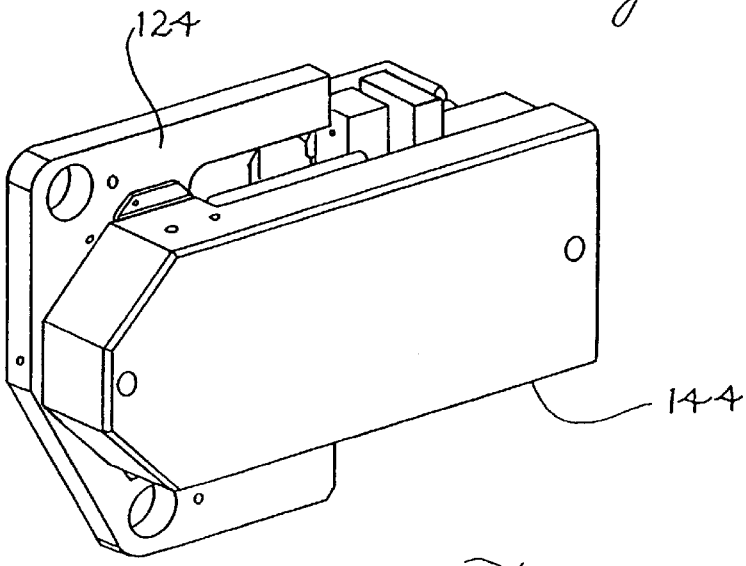
FIG. 10 is a perspective view of the rotor motor drive from the inside of the rotor carriage.

As seen in FIGS. 9–11 a servo motor 140 is secured to the outer surface of end plate 124 and is connected by a belt 142 or the like to the rotor shaft 110 of the rotor 94. The belt drive 142 is covered by a housing 144. Servo motor 140 is energized to rotate the rotor 94, 180 degrees, for each cycle after receiving a strip of severed reclosable fastener strip 22 and then the additional 6 degree to strip the reclosable fastener strip 22 from the grasp of the resilient holding mechanism 114.

Figure 14:
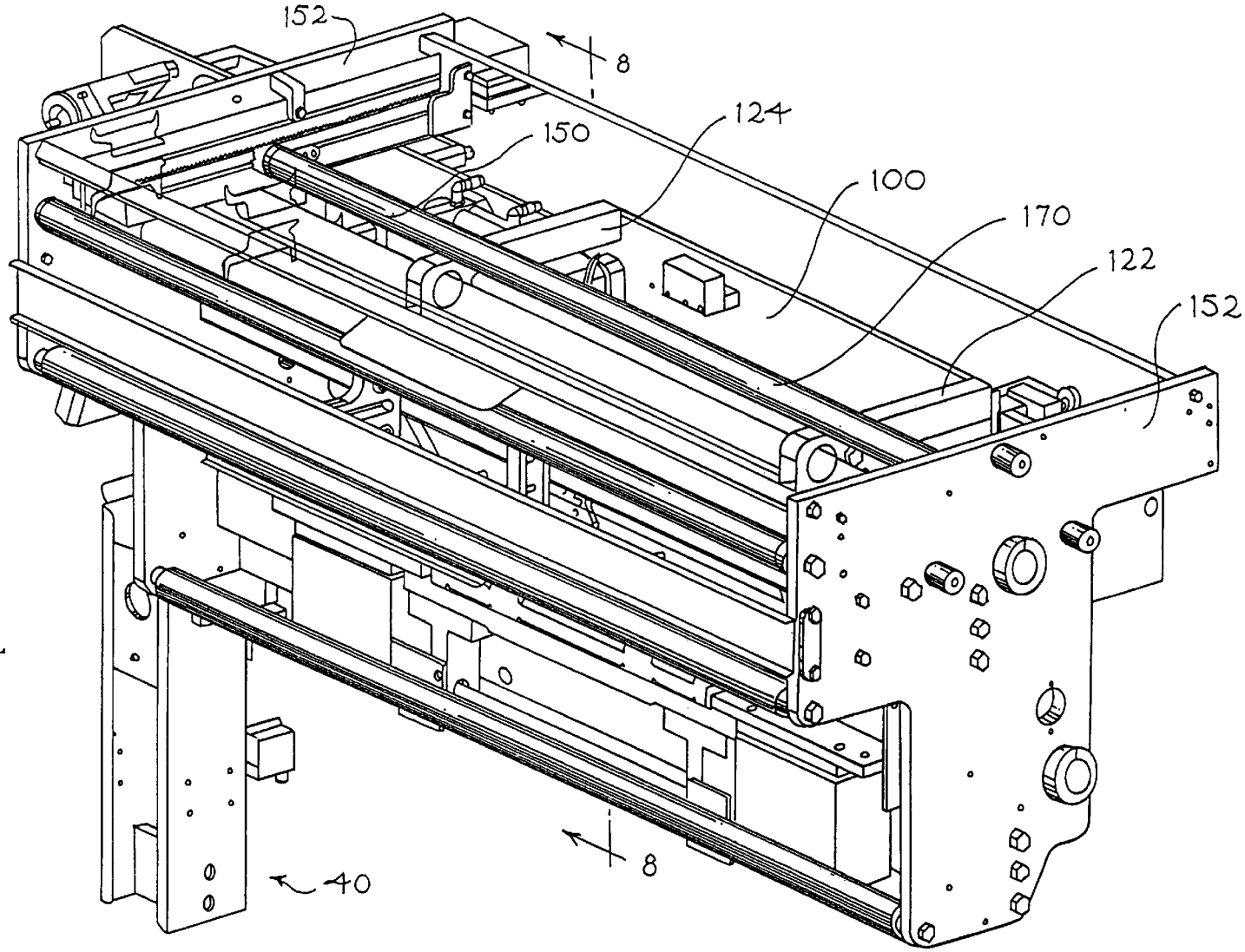
FIG. 14 is a perspective view of the placement and the zipper sealer machine.

As seen in FIG. 13 the rotor 94 is pivotally mounted on the rotor carriage 120 about rotor shaft 110. The rotor carriage 120 is carried by a pair of slide bars 150 that extend through apertures formed in end plates 122 and 124 that have been provided with anti friction slide devices 130. The slide bars 150 are secured at their ends to a pair of T-shaped end plates 152. The T-shaped end plates 152, as best seen in FIGS. 1 and 14, are carried by horizontal members 13 of the main machine frame. As a result of the slide bars 150 and the anti friction slide devices 130 the rotor carriage 120 is free to slide from between the T-shaped end plates 152. As earlier discussed, the mounting plate 100 is secured to the rotor carriage 120 through the tapped holes 104 and thus the entire zipper sealer machine chassis slides with the rotor carriage 120 between T-shaped end plates 152. This ability to slide laterally of the direction of film feed enables the reclosable fastener strip to be secured to the film at various laterally spaced positions on the film. Handle 154, that is secured to the free end of rod 156 functions to adjust the lateral location of the rotor carriage 120 between the end plates 152. The rod 156 has external threads formed thereon and extends through a knob 158 that is carried by end plate 152. The knob 158 has internal threads that mesh with the external threads of rod 156. The end of rod 156, opposite handle 154, is attached to the rotor carriage end plate 124 such that it can rotate relative thereto while transmitting lateral movement in either direction to the rotor carriage 120.

The film used to produce packages on form, fill and seal machines often includes printed material. This printed material, called the printout, must be coordinated with the top and bottom edges and the longitudinal scam of the package. The printout typically includes a unique symbol that can be recognized by an electric eye directed at the film. When the electric eye recognizes the symbol a signal is sent to the central processing unit of the form, fill and seal machine. One of the rollers of the film guide mechanism has an attached encoder that functions to control the length of film that is fed for each package and thus insure, with good precision, the proper location of the reclosable fastener strip. The control system uses this signal to coordinate the position of the printout in respect to the cross sealing jaws, to insure proper alignment of the printout and zipper with the physical properties of the package. In FIG. 13, the slider 160, which is carried by a cross shaft 162, carries the electric eye that scans for the symbol contained in the printout. Electric eye 164 must be properly located along cross shaft 162 so that it will be scanning the longitudinal extending corridor of the film that contains the symbol. Recognition of this marking causes a signal to be sent to the central processing unit of the form, fill and seal machine and is used as the timing base point for positioning the printout.

Figure 12:
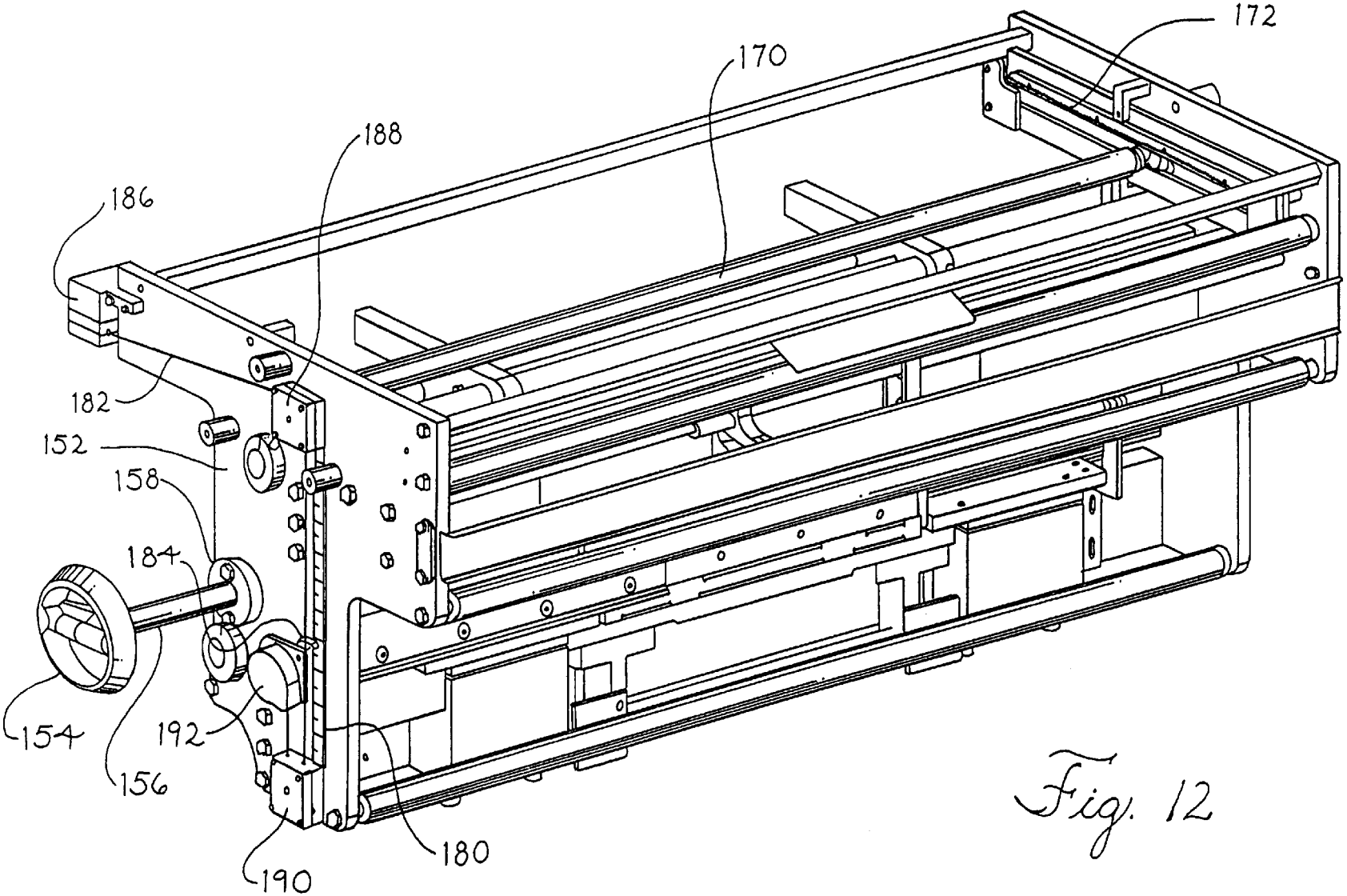
FIG. 12 is a perspective view, from the upper front, of the reclosable fastener mechanism placement assembly.

The film positioning roll 170, seen in FIG. 8, 12, 13 and 14, is a components of the film guide mechanism. As best seen in FIG. 8 the film F extends downwardly from roll 170 to a roll 174 around which it wraps and then to a roll 176 around which it also wraps. Rolls 170, 174 and 176 are all components of the film guide mechanism. Roll 170 can be adjusted fore and aft however rolls 174 and 176 are not adjustable. The strip of reclosable fastener material 22 is secured to the strand of film that extends between rolls 174 and 176. Roll 170 is movable fore and aft such that it functions to adjust the longitudinal position on the film to which the reclosable fastener strip is bonded. The portion of the film course extending between rolls 174 and 176 is not changed as a result of adjusting roll 170. Rather, the film is moved up or down relative to the location on the film that the bonding mechanism, including upper member 200 and lower bonding member 202, will engage the film when lower bonding member 202 is activated and moves upwardly. Thus, adjustment of roll 170 allows the machine operator to fine-tune the position at which the severed strip of reclosable fastener material will be bonded to the film relative to the printout. Most film that is used to produce packages has printed material on it and it is important that the top and bottom of the package is properly oriented with respect to this printout. If roll 170 is moved forward or backward along tracks 172, the position at which the reclosable fastener strip will be secured, relative to the printout, is adjusted. As seen in FIG. 12, a scale 180 is provided on the outer face of T-shaped end plate 152. The roll 170 has an arm 171, see FIG. 13, to which a line or cord 182 is attached. The line 182 extends from arm 172 to a member 186. The line or cord 182 can be seen in FIG. 12 coming out of member 186, extending generally horizontally through member 188 and turning downwardly. The line then enters member 190 from which it turns up and extends into winder 192. Members 186, 188 and 190 each include anti-friction devices such as rollers over which the line 182 extends so the line can change direction with minimum friction. Winder 192 is spring loaded and maintains the line 182 taut. The line or cord 182 has a pointer 184 secured thereto at a location such that the pointer moves over the scale 180 as roll 170 is adjusted within its range. The position of pointer 184 relative to the scale 180 indicates the exact location of film positioning roller 170. The elements 180–192 thus function as a take up mechanism.

The film path from the point where the bonding mechanism, including members 200 and 202, bond the reclosable fastener strip to the film to the point where the cross scaling jaws produce the cross seal must be of a length that when divided by the bag length equals an integer. The take up mechanism 180–192 permits length to be added to or subtracted from an existing film path length to attain the necessary zipper position with respect to the bag cutoff. This adjustment is made when the form, fill and seal machine is making bags from clear film and when bags having printing on the film are being produced.

When producing bags from film that has printing thereon, it is conventional to include in the printing indicia know in the industry as the "eye-spot." An electric eye is aimed at the longitudinal line along the film where the eye-spot is located. When the electric eye recognizes an eye spot a signal is sent to the central processing unit 300 that controls the form, fill and seal machine. The central processing unit 300 uses this signal to determine when the film feed must be stopped to enable the cross seal jaws to be closed. As a result the cross seal of the bag is properly orientated with respect to the printing thereon. Thus, when running printed bags the location at which the cross seal is applied is considered the fixed position and adjustment is made through the take up mechanism 180–192 to bond the reclosable fastener strip at a location along the film path that is an integer times the bag length from this fixed position. The take up mechanism 180–192, that causes the film to move between guide rollers 174 and 176, is manipulated until the reclosable fastener strip is bonded at the desired location. In other words it is as though the cross seal jaws were closed on the film at the proper position relative to the printing on the film and adjustment is made through the take up mechanism 180–192, causing the film to move between guide rollers 174 and 176, until the exact film position under the zipper bonding member 200 is attained.

Figure 15:
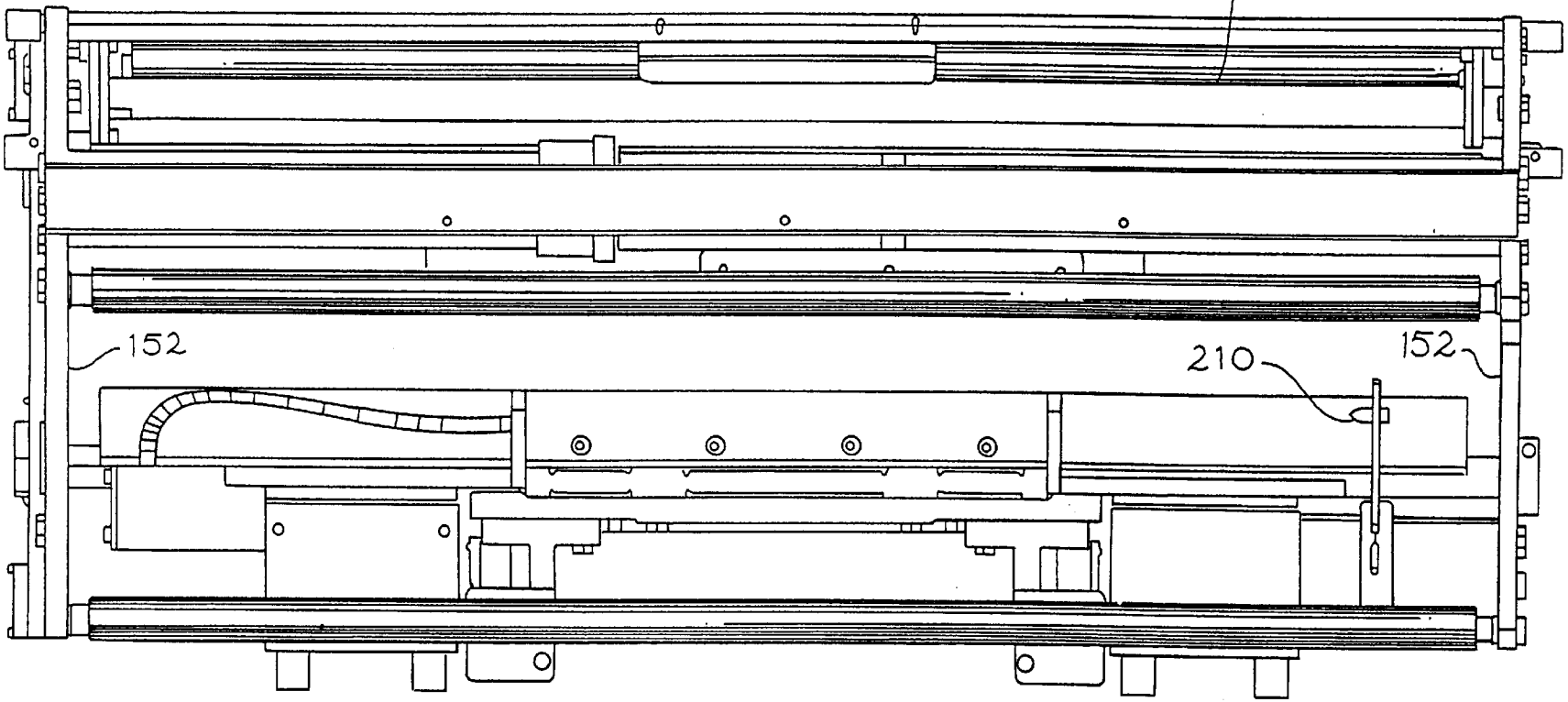
FIG. 15 is a front view of the zipper sealer machine.

The sealer or bonding mechanism for applying the reclosable fastener strip to the surface of the film before that section of the film reaches the forming shoulder 16 must be timed with the cross jaws of the form, fill and seal machine 10 since both of these operations are performed while the film is at rest. A sealer detector proximity switch 210, as shown in FIG. 15, is provided to recognize the sealer, or bonding mechanism, in its sealing position. The reclosable fastener strip is being sealed to the film surface when the sealer is at this position. Proximity switch 210 sends signals when the bonding procedure is initiated and when it is finished. When the signal from proximity switch 210 is received by the central processing unit 300, the time for actuating the rotor is determined to assure release of the reclosable fastener strip from the rotor.

In some instances, a dry air, film and seal cooling device is provided that blast a stream of air on the film when the film is advancing toward the forming shoulder 16 with the reclosable fastener strip 22 bonded to it. The purpose of the dry air is to cool the reclosable fastener strip and film so that when it goes over the next roller the reclosable fastener strip will not be separated.

Figure 16:
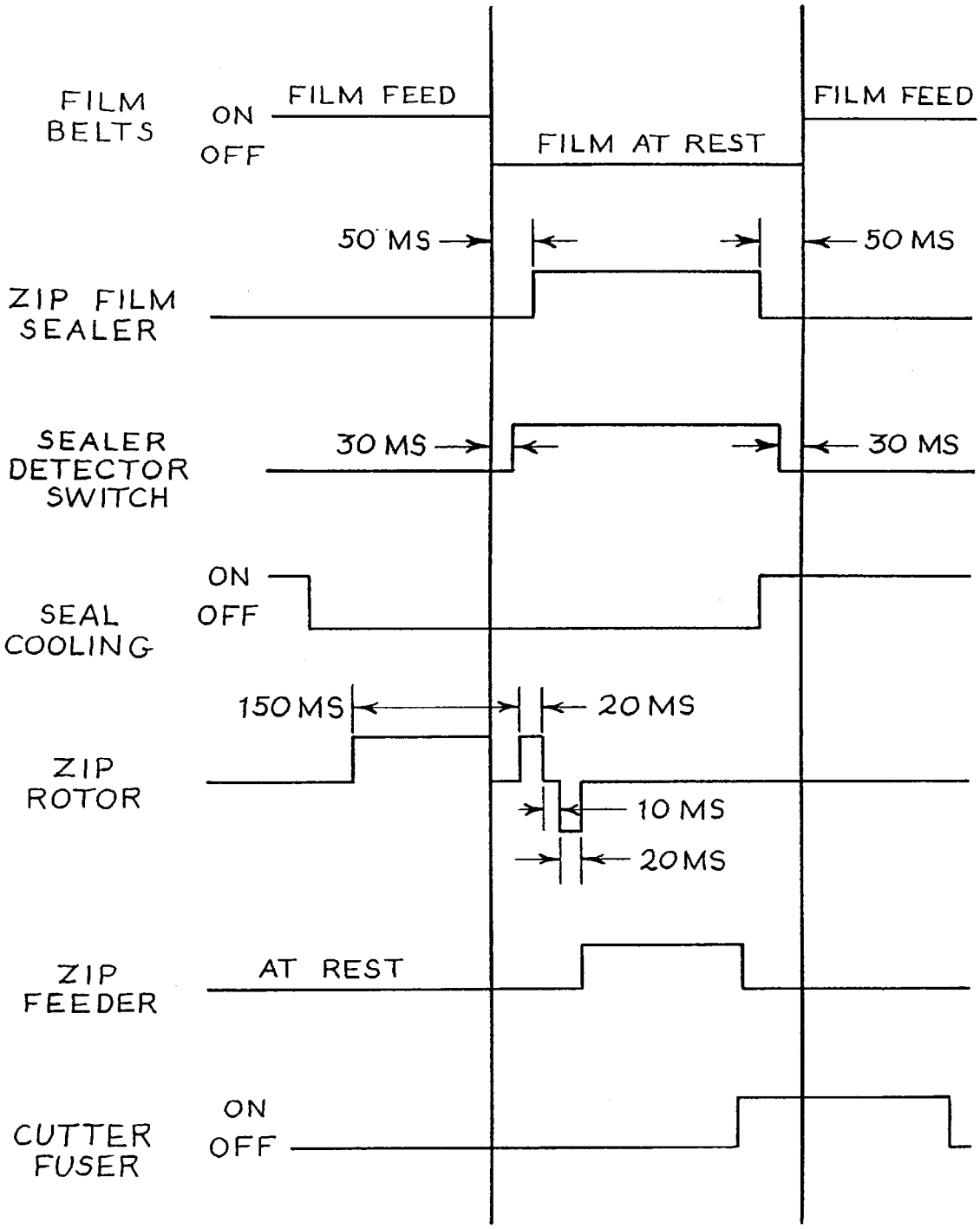
FIG. 16 is a timing diagram for the zipper scaler machine components.
Figure 19:
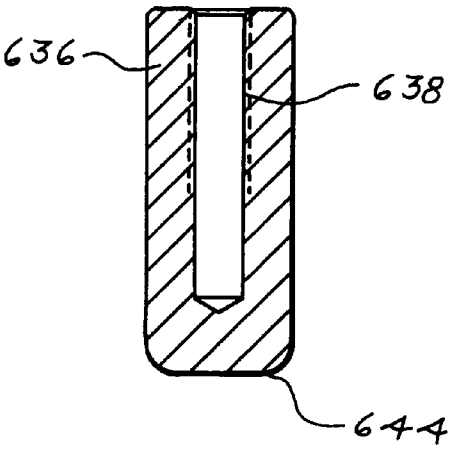
FIG. 19 is a cross section view of the air cylinder brake plunger taken along lines 19—19 of FIG. 18.

FIG. 16 is a timing diagram that illustrates the timing relationships of the various components that cooperate to prepare the strip of reclosable fastener material 22 and seal it to the inside surface of the film. The timing diagram illustrated in FIG. 16 is for a package forming system in which the film is being fed for about 60% of the cycle and is stationary, for about 40% of the cycle. While the film is stationary, the reclosable fastener strip 22 is sealed to the upper surface of the film before the film reaches the forming shoulder 16. At the same time, the cross-sealing jaws are energized to close the top of a package that has just been completed and seal two flanges of the zipper to the film. In some embodiments, the cross-sealing operation also creates a perforation between the seals. This cross-sealing operation creates the bottom seal for the next package to be filled and sealed.

The first component in the timing chart is the film belts which pull the film down the forming tube 18. The film belts are ON while the film is being fed and OFF when the film is at rest. The section of this timing line that is at the OFF level represents the approximately 40% of the package cycle during which the film is stationary. Assuming that the form, fill and seal machine is producing 60 packages per minute, the film would be at rest for approximately 400 milliseconds.

The next component shown in the timing chart is the reclosable fastener sealer.

The sealer is activated while the film is being fed but arrives slightly after the film comes to rest and is completed slightly before the film begins to feed again. In the timing diagram, both of these short time periods are indicated to be 50 milliseconds, however the period is exemplary only and they could vary from those indicated in this figure.

The next component in the timing chart is the sealer detector proximity switch. This device detects the presence of the zipper sealer in the area of the zipper sealing process. The sealer detector proximity switch is activated slightly after the film comes to rest and is deactivated slightly before the film begins to feed again. In the timing chart these short periods are shown as being 30 milliseconds, and the proximity switch is activated and deactivated while the film is at rest. The timing chart also shows that sealer detector proximity switch is activated just before the sealer is at its sealing position and remains activated for as long as the sealing process is maintained.

The next component is the dry-air seal cooling device. As illustrated by the time line, this device is not activated until the sealer is deactivated.

The next component is the rotor. The rotor is rotated 180 degrees while the film is being fed, and the rotation is shown to take about 150 milliseconds. At the same time that the sealer is detected, the rotor is rotated another 6 degrees. As previously discussed, this 6-degree rotation causes the section of reclosable fastener strip to be pulled out from under the resilient holding mechanism of the rotor. The rotor is then rotated 6 degrees in the reverse direction which prepares the other side of the rotor to be in position to receive the reclosable fastener material. During the time interval that the rotor is continuing its rotation to release the reclosable fastener strip from the rotor and then reversing its rotation to properly locate the rotor to receive the next length of material, the severed end of the continuous supply of reclosable fastener material is pre-advanced to a location adjacent the edge of the rotor. This reduces the time required to complete the advance of the reclosable fastener material to its proper location relative to the rotor and helps in targeting the zipper with respect to the rotor track.

The next component shown in the timing chart is the reclosable fastener feeder. As best seen by comparing the time lines for this component and the time line for the rotor, the pre-advancing of the material occurs at a relatively low speed while the rotor is advancing a small amount and then reversing this same small amount which is indicated in FIG. 16 as first low step. Feeding of the material at full speed does not start until the rotor has been rotated 6 degrees in the reverse direction. The time duration for this feeder to be ON depends upon how long or short the reclosable fastener section will be.

The next component shown in the timing chart is the reclosable fastener fuser. This component should begin its cutting-fusing process soon after the feeding of the reclosable fastener material has been completed. Since there will be a considerable time delay between when the pneumatic cylinders 78 and 86 are activated and when the jaws 62 and 64 engage the reclosable fastener material, the reclosable fastener fuser is activated while the feeder is still active. This cutter is timed to engage the reclosable fastener material immediately when it come to rest.

While the invention has heretofore been described in detail with particular reference to illustrated apparatus, it is to be understood that variations, modifications and the use of equivalent mechanisms can be effected without departing from the scope of this invention. It is therefore intended that such changes and modifications be covered by the following claims.

It is intended that the accompanying drawings and foregoing detailed description is to be considered in all respects as illustrative and not restrictive, the scope of the invention is intended to embrace any equivalents, alternatives, and /or modifications of elements that fall within the spirit and scope of the invention, and all changes which come within the meaning and range of equivalency of the claims are therefore intended to be embraced therein.

What is claimed is:

1. A zipper sealer machine for use on a form, fill and seal machine for forming reclosable packages having a reclosable fastener material adjacent to a cutoff of the package, including a central processing unit for controlling its operations, a roll of package forming film that feeds a continuous sheet of film, a forming shoulder and a film control mechanism that causes the continuous sheet of film to follow a film feed course from said roll to said forming shoulder, said reclosable fastener material extending transverse to the film feed course wherein the improvement comprises:

a reclosable fastener material feeding, severing, fusing and bonding mechanism adapted to be mounted on the form, fill and seal machine;

a reclosable fastener material feeding mechanism, mounted on said reclosable fastener material feeding, severing, fusing and bonding mechanism for feeding a predetermined length of said reclosable fastener material;

a reclosable fastener material severing and fusing mechanism, mounted on said reclosable fastener material feeding, severing, fusing and bonding mechanism for severing a strip of said reclosable fastener material, at a predetermined length, and fusing the severed ends;

a reclosable fastener material rotor supported on said reclosable fastener material feeding, severing, fusing and bonding mechanism along a pivot axis that is transverse to the film feed course;

said reclosable fastener material rotor being substantially symmetrical about its pivot axis and each substantially symmetrical half having an outer edge that is substantially parallel to its pivot axis;

said pivot axis being located such that one of said outer edges is adjacent to said film feed course and said other outer edge is remote from said film, course;

said reclosable fastener material feeding mechanism being mounted on said reclosable fastener material feeding, severing, fusing and bonding mechanism relative to said rotor such that said predetermined length of said reclosable fastener material is fed to said outer edge of the rotor that is located remote from said film feed course;

a holding mechanism for holding the predetermined length of said reclosable fastener material on the outer edge of the rotor;

a rotor drive mechanism for rotating said rotor about its pivot axis such that said outer edge along which the predetermined length of said reclosable fastener material is being held moves from the location remote from said film course to the location adjacent to said film feed course;

a bonding mechanism for bonding the predetermined length of said reclosable fastener material, that is being held on the outer edge of the rotor that is adjacent to the film feed course, to the film.

2. The machine of claim 1, wherein:

said holding mechanism for holding the predetermined length of reclosable fastener material on the outer edge of the rotor being resilient.

3. The machine of claim 2, wherein:

said reclosable fastener material has a mounting flange and said predetermined length of reclosable fastener material that is held on the rotor is held with the mounting flange extending over the outer edge of the rotor.

4. The machine of claim 3, wherein:

said mounting flange of the reclosable fastener material is held stationary against a surface of the film by said bonding mechanism.

5. The machine of claim 2, wherein:

said mounting flange of the reclosable fastener material is held stationary against a surface of the film by said bonding mechanism.

6. The machine of claim 2, further comprises:

a sealer detector mounted on said reclosable fastener material feeding, severing, fusing and bonding mechanism, that recognizes when said predetermined length of reclosable fastener material is being bonded to the film, and sends a signal to the central processing unit of the form, fill and seal machine so that the central processing unit can coordinate other package forming operations with said signal.

7. The machine of claim 1, wherein:

said reclosable fastener material has a mounting flange and said predetermined length of said reclosable fastener material that is held on the rotor is held with the mounting flange extending over the outer edge of the rotor.

8. The machine of claim 7, wherein:

said mounting flange of the reclosable fastener material is held stationary against a surface of the film by said bonding mechanism.

9. The machine of claim 7, further comprises:

a sealer detector mounted on said reclosable fastener material feeding, severing, fusing and bonding mechanism, that recognizes when said predetermined length of reclosable fastener material is being bonded to the film, and sends a signal to the central processing unit of the form, fill and seal machine so that the central processing unit can coordinate other package forming operations with said signal.

10. The machine of claim 1, further comprises:

a sealer detector mounted on said reclosable fastener material feeding, severing, fusing and bonding mechanism, that recognizes when said predetermined length of said reclosable fastener material is being bonded to the film, and sends a signal to the central processing unit of the form, fill and seal machine so that the central processing unit can coordinate other package forming operations with said signal.

11. The machine of claim 1, wherein:

said reclosable fastener material feeding, severing, fusing and bonding mechanism being laterally adjustable relative to said form, fill and seal machine to permit bonding of the reclosable fastener material at selected lateral positions on said package forming film.

12. The machine of claim 1, wherein:

said form, fill and seal machine having a standby mode;

said reclosable fastener material feeding mechanism including a track having a discharge end through which said reclosable fastener material is fed;

said reclosable fastener material feeding mechanism being reversible, such that in response to a signal from the said central processing unit indicating that the machine is in the standby mode, said feeding mechanism will reverse and draw the reclosable fastener material that is in said severing and fusing mechanism back into said track through said discharge end where it will be protected from said severing and fusing mechanism.

13. The machine of claim 1, further includes:

a position adjusting roll for fine-tuning the position at which the predetermined length of said reclosable fastener material is bonded to the film.

14. The machine of claim 1, further includes:

a reclosable fastener material presence detecting device.

15. The machine of claim 1, further includes:

a film length measuring device for the film that functions to assure proper positioning of the reclosable fastener material with respect to the cutoff of the package.

16. The machine of claim 1, wherein:

said reclosable fastener material rotor having one or more tracks in which a strip of said reclosable fastener material can be received and held.

17. the machine of claim 1, further includes:

a resilient mechanism for biasing said holding mechanism toward said rotor to resiliently hold said reclosable fastener material in place on the rotor.

18. A zipper sealer machine for use with a form, fill and seal machine, of the type for forming reclosable packages having a reclosable fastener material, including a central processing unit for controlling its operations, a roll of package forming film that is fed as a continuous sheet of film, a forming shoulder and a film control mechanism that causes the continuous sheet of film to follow a film course from said roll to said forming shoulder, said reclosable fastener material extending transverse to the film course, a roll of said reclosable fastener material that is fed as a continuous ribbon consisting of two inter locked halves, wherein the improvement comprises:

a reclosable fastener material feeding, guiding, severing, fusing and bonding mechanisms assembly adapted to be mounted at a fixed location relative to said form, fill and seal machine;

said reclosable fastener material feeding, guiding, severing, fusing and bonding mechanisms assembly including a material feeding mechanism that is adapted to feed a predetermined length of reclosable fastener material including a free end portion from said roll of reclosable fastener material for each package to be formed;

said reclosable fastener material feeding, guiding, severing, fusing and bonding mechanisms assembly including a material guiding mechanism having a guide way that function to constrain said ribbon of reclosable fastener material such that it can be accurately fed without buckling; and said reclosable fastener material feeding, guiding, severing, fusing and bonding mechanism assembly including severing and fusing mechanism that sever the reclosable fastener material and fuse the severed ends of the two interlocked halves together.

19. A zipper sealer machine for use with a form, fill and seal machine, as recited in claim 18, wherein said reclosable fastener material feeding, guiding, severing, fusing and bonding mechanisms assembly includes a severing mechanism that severs said reclosable fastener material at a location along said reclosable fastener material such that the severed portion includes said free end portion, said continuous ribbon and the portion including the free end portion of the reclosable fastener material being in said guide way before and after the severing except for a point at which the severing and fusing occurs.

20. A zipper sealer machine for use with a form, fill and seal machine, as recited in claim 19, wherein said material guiding mechanism includes a first section that functions to constrain said ribbon of said reclosable fastener material upstream of said severing mechanism and a second section that functions to constrain said ribbon of reclosable fastener material downstream of said severing mechanism.

21. The machine of claim 1, wherein:

said form, fill and seal machine having a standby mode;

said guide way having a discharge end through which said reclosable fastener material is fed;

said reclosable fastener material feeding mechanism being reversible, such that in response to a signal from the said central processing unit indicating that the machine is in the standby mode, said feeding mechanism will reverse and draw the reclosable fastener material that is in said severing and fusing mechanism back into said guide way through said discharge end where it will be protected from said severing and fusing mechanism.

* * * * *

UNITED STATES PATENT AND TRADEMARK OFFICE

CERTIFICATE OF CORRECTION

PATENT NO. : 6,219,993 B1
DATED : April 24, 2001
INVENTOR(S) : John M. Linkiewicz It is certified that error appears in the above-identified patent and that said Letters Patent is hereby corrected as shown below:

Claim 1, Column 16,
Line 26, after "film" insert -- feed --.

Claim 18, column 18,
Line 29, change "sever" to -- severs --.
Line 30, change "fuse" to -- fuses --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*